US006190267B1

(12) United States Patent
Marlowe et al.

(10) Patent No.: US 6,190,267 B1
(45) Date of Patent: Feb. 20, 2001

(54) GOLF CLUB HEAD CONTROLLING GOLF BALL MOVEMENT

(75) Inventors: Christian Paul Marlowe, Nederland; James Robert Cope, Atwood, both of CO (US)

(73) Assignee: COPEX Corporation, Atwood, CO (US)

( * ) Notice: Under 35 U.S.C. 154(b), the term of this patent shall be extended for 0 days.

(21) Appl. No.: 09/169,703

(22) Filed: Oct. 9, 1998

Related U.S. Application Data

(63) Continuation-in-part of application No. 08/963,978, filed on Nov. 4, 1997, now abandoned, which is a continuation of application No. 08/599,094, filed on Feb. 7, 1996, now abandoned.

(51) Int. Cl.[7] ..... A63B 53/02

(52) U.S. Cl. ..... 473/314; 473/342; 473/345; 473/349

(58) Field of Search ..... 473/290, 291, 473/297, 305, 306, 314, 316, 334, 341, 342, 343, 345, 349

(56) References Cited

U.S. PATENT DOCUMENTS

| | | |
|---|---|---|
| 1,210,182 | 12/1916 | Lynch . |
| 1,658,447 | 2/1928 | Lantz . |
| 1,673,361 | 6/1928 | Heeter . |
| 1,950,342 | 3/1934 | Meshel . |
| 2,051,083 | 8/1936 | Hart . |
| 2,076,340 | 4/1937 | Hadden . |

(List continued on next page.)

OTHER PUBLICATIONS

*Introductory Circuit Analysis,* S. Ivar Pearson and George J. Maler, Dept. Of Electrical Engineering, University of Colorado., Chapter 3.
*Dynamics of Machinery,* A.R. Holowenko, pp. 26 and 227.
*Mechanism and Machine Theory,* J.S. Rao and R.V. Dukkipati, pp. 273–277.
Theory of Machines and Mechanism, Second Edition, Shigley et al., McGraw–Hill, Inc. pp. 511–513.
Kent's Mechanical Engineers' Handbook, Design and Production Volume, Twelfth Edition, pp. 7–26 through 7–27.
Sears and Zemansky, *College Physics,* Second Edition with Supplementary Problems 1955, Addison–Wesley Publishing Company, Inc., Cambridge 4, Mass.
Copex Custom Golf Clubs brochure, 1985, Boulder, Colorado.
The New TPS Irons pamphlet, publication date unknown.
1995–1996 ProGear Pamphlet, publication date unknown.
Swix European Engineering brochure, publication date unknown.
Explore the Outer Limits, Cleveland Golf pamphlet, publication date unknown.
Super Titanium Distance and Control Have Never Been Better!, Thunderbolt brochure, publication date unknown.
True Temper. Setting the New Standard In Shafts, brochure, publication date unknown.
At Atrigon, we set out to change the face of golf, BlackHawk brochure, publication date unknown.
Graman Graphite Golf Shaft brochure, Geosan Co., Ltd. brochure, publication date unknown.
Golf Magazine (Wood Face Magazine and Patent References) Mar. 1998, pp. 0, 74, 76–79, 8–84, 86–88, 104.

* cited by examiner

*Primary Examiner*—Sebastiano Passaniti
*Assistant Examiner*—Stephen L. Blau
(74) *Attorney, Agent, or Firm*—Sheridan Ross P.C.

(57) ABSTRACT

A golf club head for a golf club is provided. The club can have weights to move the club head center of gravity and club head center of percussion to desired locations to yield desired ball control.

3 Claims, 19 Drawing Sheets

U.S. PATENT DOCUMENTS

| | | | | |
|---|---|---|---|---|
| 2,768,921 | | 10/1956 | Pigg | 154/91 |
| 2,782,035 | | 2/1957 | East . | |
| 3,075,768 | | 1/1963 | Karns . | |
| 3,083,969 | | 4/1963 | Bills et al. . | |
| 3,286,004 | | 11/1966 | Hill et al. | 264/45 |
| 3,474,048 | | 10/1969 | Chappelear et al. | 260/2.5 |
| 3,595,577 | | 7/1971 | Hedge . | |
| 3,912,277 | | 10/1975 | Pelz . | |
| 3,938,964 | | 2/1976 | Schmidt . | |
| 3,941,390 | | 3/1976 | Hussey . | |
| 3,970,236 | | 7/1976 | Rogers | 228/196 |
| 4,203,598 | | 5/1980 | Stuff et al. . | |
| 4,280,700 | * | 7/1981 | Plagenhoef | 473/289 |
| 4,461,479 | | 7/1984 | Mitchell . | |
| 4,600,196 | | 7/1986 | Hunter . | |
| 4,674,746 | | 6/1987 | Benoit . | |
| 4,690,407 | | 9/1987 | Reisner . | |
| 4,725,062 | * | 2/1988 | Kinney | 473/314 |
| 4,887,815 | | 12/1989 | Hughes et al. . | |
| 4,934,703 | | 6/1990 | DeLaney . | |
| 4,966,369 | | 10/1990 | Griffin . | |
| 5,004,241 | | 4/1991 | Antonious . | |
| 5,076,585 | | 12/1991 | Bouquet . | |
| 5,078,398 | | 1/1992 | Reed et al. . | |
| 5,094,101 | | 3/1992 | Chastonay . | |
| 5,094,457 | | 3/1992 | Kinoshita . | |
| 5,152,527 | | 10/1992 | Mather et al. . | |
| 5,197,733 | | 3/1993 | Schroder . | |
| 5,244,209 | | 9/1993 | Benzel . | |
| 5,255,914 | | 10/1993 | Schroeder . | |
| 5,261,669 | | 11/1993 | Kochevar . | |
| 5,269,518 | | 12/1993 | Kobayashi et al. . | |
| 5,295,686 | | 3/1994 | Lundberg . | |
| 5,306,008 | | 4/1994 | Kinoshita . | |
| 5,310,185 | | 5/1994 | Viollaz et al. . | |
| 5,333,861 | | 8/1994 | Mills . | |
| 5,346,216 | | 9/1994 | Aizawa . | |
| 5,354,055 | | 10/1994 | MacKeil . | |
| 5,364,102 | | 11/1994 | Appledorn . | |
| 5,374,062 | * | 12/1994 | Kochevar | 473/312 |
| 5,417,419 | | 5/1995 | Anderson et al. . | |
| 5,419,559 | | 5/1995 | Melanson et al. . | |
| 5,425,538 | | 6/1995 | Vincent et al. . | |
| 5,429,353 | | 7/1995 | Hoeflich . | |
| 5,429,357 | | 7/1995 | Kobayashi . | |
| 5,431,396 | | 7/1995 | Shieh . | |
| 5,433,440 | | 7/1995 | Lin . | |
| 5,465,967 | | 11/1995 | Boeckenhaupt . | |
| 5,494,281 | | 2/1996 | Chen . | |
| 5,562,551 | | 10/1996 | Rife | 473/291 |
| 5,608,160 | | 3/1997 | Chastonay . | |
| 5,613,917 | | 3/1997 | Kobayashi et al. | 473/335 |
| 5,629,475 | | 5/1997 | Chastonay . | |
| 5,647,806 | | 7/1997 | McDevitt | 473/252 |
| 5,649,872 | | 7/1997 | Antonious | 473/332 |
| 5,735,755 | | 4/1998 | Kobayashi | 473/342 |
| 5,755,624 | * | 5/1998 | Helmstetter | 473/345 |
| 5,776,011 | | 7/1998 | Su et al. | 473/345 |
| 5,792,946 | | 8/1998 | Chastonay . | |

PRIOR ART

GOLF CLUB HEAD CONTROLLING GOLF BALL MOVEMENT

This is a continuation-in-part application of Ser. No. 08/963,978 filed Nov. 4, 1997, now abandoned, which is a continuation application of Ser. No. 08/599,094, filed Feb. 7, 1996, now abandoned.

BACKGROUND

Field of Invention

Clubhead Heel Weight

The present invention relates generally to golf clubs and specifically to peripherally weighted golf clubs. In the past 100+ years of golf club design evolution, several key parts of the golf club have moved to today's commercial design practices and accepted principles of operation. Lengths of the clubs have standardized (ie the most common Driver is 43 to 45 inches in length), weight of the clubhead itself have stabilized (ie Driver heads generally weigh 190–210 grams), weight of the golf shaft has been reduced (ie graphite construction shafts for woods are in the 50 to 75 grams weight), the end result is construction of clubs that meet the needs of the majority of golfers, both men and women, young and old.

One facet of a golf club that has been advertised, discussed, argued about, and generally misunderstood is the 'Sweet Spot' of the clubhead itself. In the literature on golf club construction and performance this 'Sweet Spot' is described mainly as a single point where the maximum amount of energy is transferred to the golf ball when it is struck during the golf swing. Contact at this point is also considered optimum because no sideways spin motion is imparted to the ball. This results in the golfer hitting a straighter shot. This is the goal of all golfers. The problem here arises from the fact that all golf club manufacturers describe the 'Sweet Spot' as nothing but a 'spot' of unknown size on the face of the clubhead. When a manufacturer advertises that the 'Sweet Spot' on his club is larger, it is never defined how much larger, or how big it is.

The largest, most recent development in golf club design over the past 15–20 years was the increase in rotational inertia of the clubhead itself. This was accomplished with the development of the metal (hollow) wood clubs and the irons with weight moved to the edges around the face itself. It has been believed that this increase in rotational inertia about the face center-point has increased the 'Sweet Spot'. This improved playability of the clubs resulting in straighter shots with more control of the results by the golfer.

The development of increased rotational inertia had a part in increasing the accuracy of the golf shots. However the improvement was not in the form most commonly believed in the industry. The 'Sweet Spot' has a 2 dimensional characteristic on the club face. It is the result of space between the Center-of-Gravity (CG) of the clubhead itself, independent of the shaft which is attached, and the physical phenomena known as the Center-of-Percussion (COP). FIG. 11 shows the location of the COP 48 relative to the CG 32 of a clubhead 28 attached to a golf shaft 192. Center-of-Percussion effects are described in the literature most commonly in the Free-Body Diagram form as shown in FIG. 12. This Figure shows a body of any shape rotating about pivot axis 2 that results in formation of a COP 48, a fixed distance 182 (Sweet Spot area) past the CG 32, due to applied force F, as shown. The distance from pivot axis 2 to the CG 32 is the length 176. There is no reactive force at the pivot axis when the force passes directly through to the COP.

In the referenced literature MECHANISM AND MACHINE THEORY by J. S. Rao, (paragraph 12-2), THEORY OF MACHINES AND MECHANISMS, by J. E. Shipley and J. J. Uicker, Jr. (paragraph 13-7), and KENT'S MECHANICAL ENGINEERS HANDBOOK, Design and Production Volume, 12th Edition (pages 7-26 to 7-27), this physical condition of forces acting upon a body that pivots about a fixed axis, will pass through the COP, is described mathematically. This results in no reactive forces being generated at the pivot axis if the applied force passes through the COP itself and not the CG. The same analysis for forces acting through the Center-of-Gravity, when translation motion is present, is described in these same references. The forces applied in translation have the same effect acting through the CG, as does the rotation forces for the COP described above. Contained within the reference, COLLEGE PHYSICS, by F. W. Sears and M. W. Zemensky, (pages 213 through 220), are all of the relationships between Center-of-Gravity and Center of Percussion. How the COP and CG produce the true 'Sweet Spot' is discussed in this text.

From the referenced engineering textbooks the following equations apply to determining the various parameters (like distance to COP, rotational inertia of any solid body, pendulum period of oscillation, and etc.), and can be used in new golfhead design.

Definitions

J=Rotational Inertia about any pivot axis

LCG=Distance to Center-of-Gravity from any pivot axis

LCOP=Distance to Center-of-Percussion from same pivot axis

T=Period of Oscillation for any solid body swinging from any pivot axis (with small amplitudes of movement side-to-side)

G=Acceleration of Gravity (386.4 In/Sec)

Pi=Constant 3.1614 used in Geometry and Trig Analysis

**=Mathematical Square Function

*=Mathematical Multiply Function

W=Weight of Clubhead

Equations of Interest

J=(T**2)*W*LCG/(4*Pi2)(in-lb-sec2) Equation A

LCOP=J*G/(W*LCG)(in) Equation B

It should be noted that the Rotational Inertia (J) of any shaped body can be determined by (1) swinging the part around a pivot axis of interest, (2) measuring the LCG and W of the body, and (3) calculating it's J from the Equation A above. On the other side of the coin, if the Rotational Inertia (J) and Weight (W) are estimated reasonably close, and the Distance to CG (LCG) can be closely approximated; then the Distance to the resulting COP (LCOP) can be determined by Equation B above.

After a prototype clubhead is built the resulting location of the COP can then be measured accurately and determined by the 2C relationship that follows. The only parameter needed is the Pendulum Period of Oscillation (T). This physical relationship was developed in the U.S. Patent Record first in U.S. Pat. No. 5,269,177, Miggins, et al, (1993), and the literature references (for this patent). One can determine LCOP by making this calculation as follows:

$$LCOP=9.785*(T**2)(\text{inches}) \quad \text{Equation C}$$

Or, $$LCOP=24.81*(T**2)(\text{centimeters})$$

In a golf club making high velocity contact with a golf ball there are both translation and rotation motion occurring at the same time. With reference to FIG. 13 where a top view of a golfhead making contact with a golf ball is shown, one can see both translation 3 and rotation 4 due to Force FB. Both motions are occurring at the same time. The Principle of Superposition applies in the golf club was confirmed with laboratory analysis, and it is described in detail in DYNAMICS OF MACHINERY, by A. R. Holowenko, (1955), from a mechanical application of forces viewpoint, and in INTRODUCTORY CIRCUIT ANALYSIS, by S. I. Pearson and G. J. Maler, (1965), from an voltage (electrical form of force) analysis viewpoint. The important result of interest in the golf club is how the CG and COP share in the handling of an applied impact force FB that is made with ball contact during the golf swing.

When the point of contact occurs between the two centers (CG and COP) they each take an appropriate share of the load depending upon the relative distance to each center from the point of contact. With respect to the body of the clubhead the effects of the ball contact force are absorbed by each center producing a moment about each center. When the force is applied between the two centers then the resulting moments will cancel each other out. FIG. 14A shows how the distribution of the absorbed force FB is distributed between the CG 32 and COP 48.

These centers act as anchors (in the Percussive sense) where the applied force is absorbed (momentarily) as reactive forces FR(COP) 7 and FR(CG) 8. The magnitude of each reaction force is dependent upon the distance from the applied force location on the clubhead face. The closer a reaction force is to the applied force, the larger the reactive force will be. At the same time the farther away, the smaller the reactive force will result. Simple Static Force Analysis here will show this relationship. When the applied force contacts right on top of either the COP or CG locations then there is only one reactive force, of equal and opposite value. In all of these cases where the applied force hits between the two centers the net effect is a neutralization of the effects shown by the moments M(CG) 6 and M(COP) 5 in FIG. 14A.

When the ball is struck outside the locations of these centers (CG and COP) then a large amount of twist caused by the two resulting moments (MCG 6 and MCOP 5) being of the same numerical sign. These are adding together as shown in FIG. 14B where these moments are both turning clock-wise in the view shown. Because of this phenomena the design objective for a golf clubhead would be to stretch the distance between the two centers to a maximum value. This will provide the golfer the widest possible spot upon which to make contact. This is the true 'Sweet Spot' 182 for any golf club.

This is borne out with the evolution of the all metal wood clubs 9 from the persimmon/maple wood clubs 10 of the past. FIG. 15 shows this CG 32-to-COP 48 Sweet Spot 182 measured on two kinds of golf clubs. The spot has grown in size with the technology evolution that has taken place in golf club manufacturing. This accounts for the growth of the metal wood. It is really a better, more forgiving off-center-hit type of golf club. It would have been accepted by the golfers sooner or later.

As shown in FIG. 15, the benefits of the metal wood club are only 50% of the potential that can be obtained. The Sweet Spots of both clubs are bracketed by the CG location line 12 and COP location line 11 measured parallel from the shaft centerline 52. Note that on the metal wood clubhead there is a large area where if the ball is struck there would create a large twisting moment. This areas is the entire inside half of the clubhead face measured from the CG location line 12 towards the shaft centerline 52.

When a golfer hits in this area he/she will pull the ball left of the target line setup for the golf shot. The Metal Wood has a larger Sweet Spot than the Persimmon Club. The improvement over the Persimmon/Maple wood club is significant and readily supports why the metal wood has grown in popularity the past 10 to 15 years. Note that there is room for improvement again by producing a golf club that utilizes the whole area of the club face for this Sweet Spot with the CG and COP locations straddling the entire ball hitting zone.

The view of the Sweet Spot (defined herein) shown in the various Figures, show an area running parallel to the shaft center-line, out on the face. Some areas are larger than others (for the appropriate reasons given) however all have their outer limit 11 and inner limit 12 on the clubface parallel to each other, and parallel to the shaft centerline. There is another pivot axis located at the second weakest area of the whole golf club. This is shown in FIG. 16 as Axis X—X 13. This pivot axis is due to the COP 48B of the entire golf club (normally located 1 to 3 inches above the clubhead). It is measured from the middle of the golfer's grip at the butt end of the club shaft 192. It is measured with same procedure used for a clubhead. When ball impact is made on the clubface below this Node point (on Axis X—X 13) the clubhead may tend to rotate back, in-line with the moving direction of the club. This rotation is about this COP 48B on the shaft just above the clubhead 9. This is a high stress point. Probably as high as 90% of all golf club shaft breakage occurs at this point. If this second pivot is as weak as the rotation pivot at the shaft tip, then the Sweet Spot is further reduced as shown in FIG. 16 where COP 48A is established past the CG 32 on a line 12 parallel to the shaft centerline 52. Thus reduces the Sweet Spot area 182 as shown. The new pivot point established by COP 48B (for the whole club) produces a new outer limit 11A that is past the new inner limit 12A. Thus lines 11, 12A, 12 and 11A define a more narrow Sweet Spot 182 area. Moving the whole club COP 48B down the shaft further to the clubhead, and keeping the clubhead CG 32 higher up inside the head itself will increase the Sweet Spot area 182 in this respect. For every pivot axis selected there is a corresponding Center-of-Percussion's 48,48A on the opposite side of the body's Center-of-Gravity.

Field and laboratory testing has shown that the rotation around the shaft during impact dominates. The pivot axis around the shaft tip is much weaker in rotation than the pivot axis X—X 13 (defined in FIG. 16) is in bending. Consequently the Sweet Spot 182 controlling the golf shot is between the parallel inner limit 12 and outer limit 11 defined in FIG. 15B.

Golf Club Butt Weight

FIG. 2C shows the vibration that a golfer encounters everytime he/she hits a golf ball. The Center-of-Percussion (COP) of the entire golf club measured from the grip end of the shaft is generally located up, off the clubhead from 1 to 3 inches, depending upon the weight of the golf shaft. The reason golf gloves are worn by the majority of golfers is to help soften the shock and vibrations encountered when the golf ball is struck with any appreciable energy. This shock and vibration can cause 'tennis elbow' to occur with golf clubs built in this manner. In the past years the weight budget, or distribution, of component's individual weights such as the grip, shaft and clubhead, have evolved to automatically place the COP above the clubhead in this manner. Older Persimmon Drivers with very heavy shafts have this COP located from 4 to 6 inches above the clubhead. The end result is that the clubhead will go into vibration mode (note the COP is in reality the First Node of Vibration of any assembled body about a pivot axis-as shown in FIG. 2C) upon contact with any sharp input such as hitting the golf ball. With the advent of lighter weight golf shafts being produced such as the earlier (1980's) Vanadium Steel shafts, and later (1990's) the lighter weight graphite shafts; then this COP location has shifted closer to the clubhead, but still outside the clubhead volume. With today's graphite shafts in the 50–75 grams weight range the location of the entire club's COP is within 1 inch above the top of the clubhead. The problem with very light weight graphite shafts is that, with classic design approaches to placing the Center-of-Gravity (CG) at the geometric center of the clubhead, they will easily allow Toe-Down and Increased Loft during the downswing. This is due to the before-mentioned Centrifugal forces generated by the golfer during he/her swing. The light weight (50–75 gram range) golf shaft has not made a significant penetration into the golf marketplace because the Toe-Down and Increased Loft issue is larger with these shafts.

Consequently the advantage of moving the COP down the shaft using a light-weight shaft has not been realized for the majority of golfers. One must incorporate the Butt Weight advocated in this patent to force the COP to move to a specific position within the clubhead itself. FIG. 2A shows the ideal vibration mode when the COP is placed correctly within the golf clubhead.

Clubhead Wood Face Insert

Persimmon and Laminated Maple woods evolved as the materials of choice for 'Wood' golf clubs from early times. Laminated Phenolic Face Inserts were added to the main hitting area of the club face for longer life of the clubs. FIG. 5B shows the Face Insert 160 inlaid to a Wood Clubhead 28. Other materials have been used in place of the Phenolic inserts also.

Persimmon wood golf clubs exhibited a 'sound' at ball contact that is pleasing to golfer's ears, plus the sound gave good feedback to the golfer that a good shot had been executed. In the last 15 years the Persimmon golf club has essentially been replace by the Metal Wood Clubhead. There are good performance reasons why this replacement occurred and are discussed in other sections of this patent.

However, Metal Wood Clubheads exhibit a 'harsh', 'abrasive' sound at ball contact because the clubhead face is made of metal of various kinds. The most common materials used today are Steel and Titanium. It has been found that the metal faces can be dented, or generate flat spots, with use. Bulge and Roll are golf club features that aid the golfer in hitting a straight shot. All Persimmon and Maple clubs of the past had Bulge and Roll cut into their faces. Most metal wood clubheads today (but not all) have some kind of Bulge and Roll formed into their faces at manufacture. The Bulge and Roll aids the shot made by the golfer by engaging what is called 'Gear Effect' in order to correct shots hit on the toe, or hit on the heel of the clubhead. When this Bulge and Roll feature is compromised by flat spots or dents on the face the golfer will have difficulty in hitting good golf shots. This is because without the Bulge and Roll effects being in effect the golfer will have to contact the golfhead face directly in it's geometrical center. The Bulge and Roll dimensions placed into a metal wood clubface help stiffen the face when the large ball contact forces are encountered as well as provide the Gear Effect benefits. Golfers find today that when their steel drivers don't hit the same anymore and they are quick to blame their swings. Buying another driver fixes the problem—temporarily.

Metal wood clubheads are more durable from wear point of view. They have raised the expectations of the golfer with regards to looks and durability.

2. Description of Prior Art

Clubhead Heel Weight

The use of Center-of-Percussion (COP) in the patent record is a fairly recent occurrence. Searching for patents that call out COP in their Abstracts reveal a number of such patents in the modern U.S. PTO computer record. Of these patents all but a few refer to, or use Center-of-Percussion incorrectly in their specification. Of these patents, the term COP is actually used to describe the geometric center of the golf club face. There are no mentions of how to calculate the COP. They do not show the Center-of-Gravity (CG) in a different location than the COP. Nor do they develop any mathematical basis for the COP term used. These patents are as follows:

| U.S. Pat. No. | Inventor | Title | Issue Date |
|---|---|---|---|
| 3,912,277 | Pelz | Golf Club | Oct 14, 1975 |
| 4,025,078 | Pelz | Attachment for . . . Club | May 24, 1977 |
| 4,089,384 | Ehrenberg | Self-Propelled . . . Vehicle | May 16, 1978 |
| 4,655,459 | Antonious | Golf Club Head | Apr 7, 1987 |
| 4,826,172 | Antonious | Golf Club Head | May 2, 1989 |
| 4,907,806 | Antonious | Perimeter Weight . . . | Mar 13, 1990 |
| 4,915,386 | Antonious | Perimeter Weight . . . | Apr 10, 1990 |
| 4,938,470 | Antonious | Perimeter Weight . . . | Jul 3, 1990 |
| 4,966,369 | Griffin | Positive . . . Putter | Oct 30, 1990 |
| 5,004,241 | Antonious | Metal Wood Type . . . | Apr 2, 1991 |
| 5,026,056 | McNally, et al | Weight-Balanced . . . | Jun 25, 1991 |
| 5,048,834 | Gorman | Iron Type Golf . . . | Sep 17, 1991 |
| 5,048,835 | Gorman | Weighted Golf . . . | Sep 17, 1991 |
| 5,074,563 | Gorman | Iron Type Weighted . . . | Dec 24, 1991 |
| 5,197,733 | Schroder | Golf Club | Mar 30, 1993 |
| 5,141,230 | Antonious | Metal Wood Golf | Aug 25, 1992 |
| 5,160,143 | Dwyer | Golf Stroke Train . . . | Nov 3, 1992 |
| 5,176,383 | Duclos | Golf Club | Jan 5, 1993 |
| 5,230,509 | Chavez | Versatile Putter | Jul 27, 1993 |
| 5,230,510 | Duclos | Elevated Hosel Golf | Jul 27, 1993 |
| 5,242,167 | Antonious | Perimeter Weighted | Sep 7, 1993 |
| 5,255,914 | Schroder | Golf Club | Oct 26, 1993 |
| 5,328,184 | Antonious | Iron Type Golf . . . | Jul 12, 1994 |
| 5,333,870 | Stevenson, et al | Airborne Over . . . | Aug 2, 1994 |
| 5,390,919 | Stubbs, et al | Adjustable Golf . . . | Feb 21, 1995 |
| 5,390,924 | Antonious | Iron Type Golf . . . | Feb 21, 1995 |
| 5,395,113 | Antonious | Iron Type Golf . . . | Mar 7, 1995 |
| 5,435,559 | Swisshelm | Set of Irons . . . | Jul 25, 1995 |
| 5,497,995 | Swisshelm | Metalwood with . . . | Mar 12, 1996 |
| 5,516,106 | Henwood | Golf Club Head | May 14, 1996 |
| 5,649,872 | Antonious | Iron Type . . . | Jul 22, 1997 |
| 5,562,551 | Rife | Iron Type . . . | Oct 8, 1996 |

All of the above patents talk about Center-of-Percussion (COP) within the golf clubhead. All are actually referring to the Center-of-Gravity (CG) of the clubhead, or the geometric Center of the club face.

Kleinfelter's U.S. Pat. No. 5,090,698, issued Feb. 25, 1992, talks about the COP being expanded due to method of constructing a putter golf club. In this patent the head is in two parts held together with two outlying support sections. The patent claims that the COP is expanded because of wide stance taken by the supports either side on the CG of the head. If the supports are fastened in a hard manner then the supports will have no effect as described. This is due to the entire assembly will act as one body within the clubhead. If the supports are soft compared to the other parts then the reaction of the clubhead on the ball will be 'mushy' to the touch.

Plagenhoef's U.S. Pat. No. 4,280,700, Issued Jul. 28, 1981, teaches the correct way to represent the Center-of-Percussion and Center-of-Gravity relationships as they exist on a clubhead itself. However, where it does not apply to the intent of this patent is as follows. Plagenhoef teaches, among other items not related, to move the CG outward towards the Toe of the clubhead. It correctly shows that while doing this the COP will also move outward bringing it closer to the Toe than before. Plagenhoef claims that rotation at impact will be reduced with this feature. The discrepancy with this analysis is that making contact on the shaft side of the CG will cause a twist of large magnitude, turning the clubface counter-clockwise (for a right-handed golfer). This is due to both moments about the CG and COP have same sign and add together, rather than cancel each other out. This will result in a pulled shot, or a hooked shot trajectory. What this patent fails to do is provide protection for a shot like previously described. Here is the reason why moving the CG outward does not work.

FIG. 17, shows the physical results of a laboratory experiment where 6 identical shell boxes 14 (simulating hollow golf heads), each with an identical internal weight 15 (such as would be required by this patent), with each weight positioned such as to move the Center-of-Gravity 32 towards the Toe End 56 in increments from the center-line 52 as shown. This center-line 52, while normal to the boxes, represents the shaft location if the box were struck on the faces shown. All of the tested pieces were allowed to freely swing at pivot axis 2 and the Pendulum Period (T) 194 (shown in FIG. 23) was measured. Then using Equation C the COP 48 for each box was obtained along with determining where the CG 32 are located also. Continuing with an analysis of the resulting information shown by FIG. 17, FIG. 18 shows the results in graphic form. It can be seen that as the CG moves closer to the pivot axis 2, the COP location (indicated by value of LCOP) initially comes down towards the shaft pivot axis 2, and then moves rapidly outward, off the clubhead face completely as the CG is located right on top of the shaft centerline. This is a very important concept.

These boxes, built for this experiment, are all of dimensions close to that of a golf head. The hatched areas shown between the CG and COP change drastically as the CG is moved closer to the shaft axis. FIG. 18A shows the location for the CG (LCG) less than, or equal to 'N' (where N is outer Toe limit of the test boxes) for the Optimum Sweet Spot condition. FIG. 18B shows the effective width of the area between CG and COP. This graph is in fact a plot of the size of the 'Sweet Spot' produced between the CG and COP. One can see that the maximum area is when LCG is equal to 'N'. If the CG is allowed to get closer to the shaft axis than the 'N' 202 distance then the COP moves off the clubhead face.

For the Optimum design, the COP must be located upon the Toe of the Clubhead itself and this is defined as LHEAD 174. LHEAD is defined in FIG. 22. This location is done when the LCG dimension moves the LCOP to 56 (the outer physical limit of club head at Toe End). When a golf club head is built with the appropriate CG location and the resulting LCOP is at 56 relative to from the shaft axis then the Sweet Spot shall be optimum in size. The further out LCG moves the smaller the Sweet Spot. When it moves towards the shaft axis the COP moves off the face of the club. Clubs built and tested with the CG located directly on the shaft center-line in any radial direction showed a significant performance advantage over any commercially available golf club in terms of straighter hits and better feel for the golfer.

The Plagenhoef Patent discussed the above, where the CG is purposely moved towards the Toe of the clubhead, but it does not provide the benefits possible because the Sweet Spot is actually getting smaller as shown in FIGS. 17A–17F, inclusively. The Plagenhoef patent closely resembles FIG. 17F, where this patent looks closer to the design in FIG. 17A.

Finally, there are two patents that discuss the alignment of the clubhead Center-of-Gravity to the shaft centerline; in a manner of speaking. Hodge's U.S. Pat. No. 3,595,577 and Hussey's U.S. Pat. No. 3,941,390 both talk about putting the CG directly upon the shaft centerline. They describe benefits of NO twisting of the clubhead relative to the shaft center-line during the downswing. During the downswing a large level of Centrifugal Force is generated by the golfer. This naturally occurring force aids the golfer in generating high clubhead speeds in order to impart high energy to the golf ball. This energy translates into the 'distance' that all golfers desire. The Centrifugal effect is caused by the rotation of the golfer's body, arms, and hands in bringing the club down through the golf ball at impact. All, literally ALL, golf clubs on the commercial market today have the CG located in the center of the Clubhead, measured in all 3 axis'. FIG. 19 shows this location from the front (A), side (C), and top view (B) of a typical clubhead. When this Centrifugal force is generated, it acts through the CG of the clubhead. Moments 16 generated by this large force push the clubhead as shown in FIG. 20. In a similar view, as in FIG. 19, it can be seen that the clubhead 'Tows Down' (as shown in the front view 20A). This is because the CG is located where it is a combination of 'Rotation' (shown in top view 20B) and 'Increased Loft' (shown in side view of FIG. 20C) occurs as the clubhead twists clown and away from it's natural, unstressed (in bending) position. With the CG of the clubhead offset from the golf shaft centerline, a Rotational Torque 16 is applied that's equal to the Centrifugal force multiplied by this offset. It is a very large torque that is trying to twist the clubhead from it's as-built condition. It is present in all 3 dimensional views of FIG. 20 to some magnitude. This is because the CG of a normally built golf club is not on the shaft centerline.

This twisting away from the shaft centerline results in an errant shot. It cannot meet the golfers goals for the executed golf shot, and IS possibly the most miss-understood problem for golfer's equipment today.

Because of the Toe-Down problem the golfer must develop the ability to swing the clubhead slightly above the ball as far as his/her hands are positioned, and allow the Toe Down effect to place the clubface in-line with the ball at impact. This phenomena can be seen on any golf swing television commercial where the golfer is seen hitting a golf ball from the rear, looking towards the intended line of the golf shot by the golfer being photographed. The faster the swing the more the golfhead will Toe Down at impact. Golf shaft stiffness is used to control the amount of twist the golf club sees during the downswing due to Centrifugal Force.

The stiffer the shaft the less amount of Tow-Down, Rotation and Loft Increase will be seen with a typical downswing. However, a Stiffer Shaft injects problems with the golfer's feel and touch when hitting a golf ball, but this is outside the scope of this patent application. However 'stiffer' shafts will fix the dreaded 'slice' many golfers have in their swings. A golf club built per this patent specification will not 'slice'. The golfer must however adjust his/her swing to allow for the different trajectory of the clubhead on the downswing because of the absence of Toe Down previously described.

The Hodge and Hussey patents cited in this section both try to address this issue. The Hussey Patent attacks the conditions caused by Centrifugal Force in terms of limiting the amount of Loft Increase and Rotation that can occur. However, the way it specifies, the location of the CG (in a plane, in-line with the shaft centerline, out to the Toe) the Toe Down twisting will still occur.

The Hodge Patent has the CG located in a plane 90 degrees normal from the Hussey Patent's claim. FIG. 2 within the Hodge patent Specification itself, shows how the orientation of the CG is setup and demonstrated. This most probably reduces the Toe Down during the downswing, however, because the CG is somewhere behind the shaft centerline, the Loft Increase will occur. Neither patent specifically locates the CG dimensionally except that they are in referenced planes oriented from the shaft centerline. The statement made that the CG is located on the shaft centerline is misleading and incorrect.

Hussey's Patent projects a plane containing the CG straight out from the shaft, parallel to and behind the face of the clubhead. Hodge projects a similar CG location plane straight back from the shaft that is normal to the clubhead face. The CG's of either patent could be anywhere on the referenced planes. Neither club patent addresses Center-of-Percussion as a physical entity to deal with in golf club design process. These patents are not a factor in this patent specification.

The ideal situation of placing the clubhead CG directly on the shaft axis (measured in any radial direction) completely eliminates Toe Down, Loft Increase, and Rotation caused by Centrifugal Force during the swing. While this places the COP outside of the clubhead Toe End it is a major improvement.

Golf Club Butt Weight

Stuff, et al, in their U.S. Pat. No. 4,203,598 were the first in the U.S. Patent record to note that moving the Center-of-Percussion (COP) of the entire golf club closer the hitting zone of the clubhead. They did so by describing the use of a Butt Weight placed 5 inches above an assumed pivot axis. This pivot axis is described as the approximate center of both golfer's hands as the club is swung. In this patent Stuff, et al, do not project the COP inside the clubhead, just closer.

Benoit in his U.S. Pat. No. 4,674,324 teaches putting the COP within the volume of the clubhead, or beyond. Benoit also in his U.S. Pat. No. 4,674,746 describes a Butt Weight configuration to move the COP into the clubhead.

Chastonay's U.S. Pat. No. 5,094,101, teaches developing a fixed location of the COP for all clubs in a set, and specifically avoids placing the COP inside the clubhead itself on any club in the group.

Miggin's U.S. Pat. No. 5,269,746 teaches the correct method to determine the COP location on a baseball bat, and includes the correct mathematical equations for calculating the COP location based upon Rotational Inertia and Distance to the Center-of-Gravity (CG). Miggins's Patent is easily transported to the golf club field for anyone familiar with the field.

Chastonay's U.S. Pat. No. 5,277,059 continues teaching locating the COP at a point on the face that contacts the golf ball, but not at any specific point such as the CG itself.

McDevitt's U.S. Pat. No. 5,647,806 shows a whole club (putter) and talks about the COP on the face, but is not in the category described here of controlling the COP location of the whole club. It is rather similar to a patent described in the Clubhead Heel Weight section of this patent where the COP is used to describe the CG of the clubhead itself.

Lastly, Chastonay in his U.S. Pat. Nos. 5,417,108, 5,608,160 and 5,792,946 all talk about the COP at the clubhead in describing how to dynamically balance a golf club set, however no description or specification on where in the clubhead is the COP to be located is provided or taught. In Chastonay's U.S. Pat. No. 5,629,475 he teaches that due to the weight distribution techniques of his previous patents (mentioned above) the Center-of-Percussion (COP), while on the face of the clubhead, is on a line that does not coincide with the geometric Center of the Clubface itself. This line is, in fact, controlled by the Center-of-Gravity (CG) of the entire club with it's shaft and grip attached. In his FIG. 4 he shows this line passing through the clubhead as the club is suspending at the grip end. He advocates changing the weight distribution of the clubhead itself in order to move the Center-of-Gravity of the entire club so the line that the COP is located upon passes through the Center of the Clubhead Face. He specifically advocates putting the line that the COP passes through the clubhead right on the Center of the Club Face.

The patent description in this application makes the task of designing and building a club a bit easier because the club's COP is placed directly upon the CG of the clubhead itself. With the CG of the clubhead located upon the centerline of the golf shaft no weight distribution changes in the clubhead are required or needed.

Clubhead Wood Face Insert

Patents have been issued showing Faces made of Titanium and various Polymers mounted to a steel body. However in each case the steel body has a sub-surface face generally made of the same material as the clubhead body itself. Because of fear that the new face material may not hold up structurally with frequent ball contact the patents have provided an integral backup surface in every case.

Metal wood heads made of solid Aluminum and Magnesium have been built and marketed. These materials are not resilient enough to take the energy transfer if they were not made from solid metal stock.

The bulk of the Driver and Fairway Wood Golf clubs that are available on today's market are either Steel or Titanium bodies, including the faces. Some have various other materials inserted flush to their finished shapes that provide weight shifts like lowering the Center-of-Gravity of the clubhead within the body. Other golf clubs, such as Irons, have metal composites where Tungsten is implanted onto the Steel bodies for controlling locations of CGs and providing other advertised features. The *Driver Test Report*, by Rob Saurhaft in the August 1998 issue of Golf Magazine (pages 69 to 88), Goldwin Golf advertisement in Golf Magazine's February 1998 issue, and article showing Titleist's Titanium Driver in Golf Magazine's December 1997 issue (page 104) are all examples of where all of today's metal wood golf clubs are material-wise. An exception to today's picture of the Golf Club Market is Karsten who offers a Laminated Maple Wood Driver. The Wood Brothers Golf Club Company of Texas also offer a selection of Persimmon Drivers and Fairway Woods with ceramic faces inLaid into the head itself. There is a small inroad left towards the Classic Clubs however they need to be brought into the future of the Golf Club Market.

Rogers U.S. Pat. No. 3,970,236 was an early patent entry into combining different materials into one golf clubhead. Kobayashi et al's U.S. Pat. No. 5,613,917 is the most recent patent issued on golf club with combination materials. Su's U.S. Pat. No. 5,776,011 shows a separate face being attached to a shell body. It claims another feature that does not apply to this patent, but it does show a separate face piece that is attached in some manner such as welding. Kobayashi's U.S. Pat. No. 5,735,755 shows a separate Face piece from the main body of an iron. He makes a point of showing honeycombed structure of this face piece in order to reduce weight. He advocates the advantage of a lighter face piece formed by the honeycombed structure used. He uses a special grade of steel to provide the strength needed at the face-to-ball interface.

Objects and Advantages

Clubhead Heel Weight

Accordingly, several objects and advantages of our invention are as follows: 1) The improved Sweet Spot size (defined herein), started by the golf industry's move towards metal wood golf clubs, is further enhanced to the maximum possible size, with respect to the golf club being built—resulting in more consistent results on the golf course by the golfer using such club. 2) The natural twisting of the clubhead during the downswing due to Centrifugal Forces generated by the golfer are completely eliminated. They will result in straighter golf shots and subsequent scoring improvements for any golfer of any skill level, and 3) Make a significant dent in the difficulty most golfers have with the golf club toughest to hit in their bag—the Driver.

Golf Club Butt Weight

FIG. 2A shows a change in the vibration shape (from FIG. 2C) when the Center-of-Percussion (COP) of the whole club is located upon the Center-of-Gravity (CG) of the clubhead itself. While prior art talks about increased energy transfer when the COP is within the clubhead volume, the maximum possible energy is transferred when the COP is located on top of the clubhead CG. This feature, coupled with the CG location of the clubhead itself within 0.18 inches of the shaft centerline, provides for no energy losses to occur at golf ball contact during the downswing. This is due to the stability of Sweet Spot (defined previously in the Clubhead Heel Weight section) and due to no clubhead deflection backward at ball contact due to this feature of locating the COP within the clubhead volume AND on top of it's CG as shown in FIG. 2A.

Clubhead Wood Face Insert

Combining a Persimmon Wood, Maple Wood or Phenolic Face to an Open Mouth Metal Clubhead Shell with a Polymer Backing material added during manufacture provides a 'Wood-Metal-Wood' Golfclub that exhibits advantages of both types of club construction.

The Metal Wood weight distribution to the outer surface of the head body provides the increased Rotational Inertia (described earlier as a reason why Metal Woods have become so popular), and increased wear durability.

The Wood and Polymer Face Combination provides the touch and sound of 'classic' golf clubs when the golf ball is struck. This will aid in giving the golfer feedback on the quality of his/her golf shot. The Wood/Polymer Face is resilient and will not flatten out like a purely metal face has been seen to do with use. Consequently the Bulge and Roll built into the face will remain in-tact as long as the golfer takes care of the club. The energy transferred at ball contact is so large and fast time-wise; metal is not the best material from a resiliency viewpoint.

Still further objects and advantages will become apparent from a consideration of the ensuing description and accompanying drawings.

Figure 1:
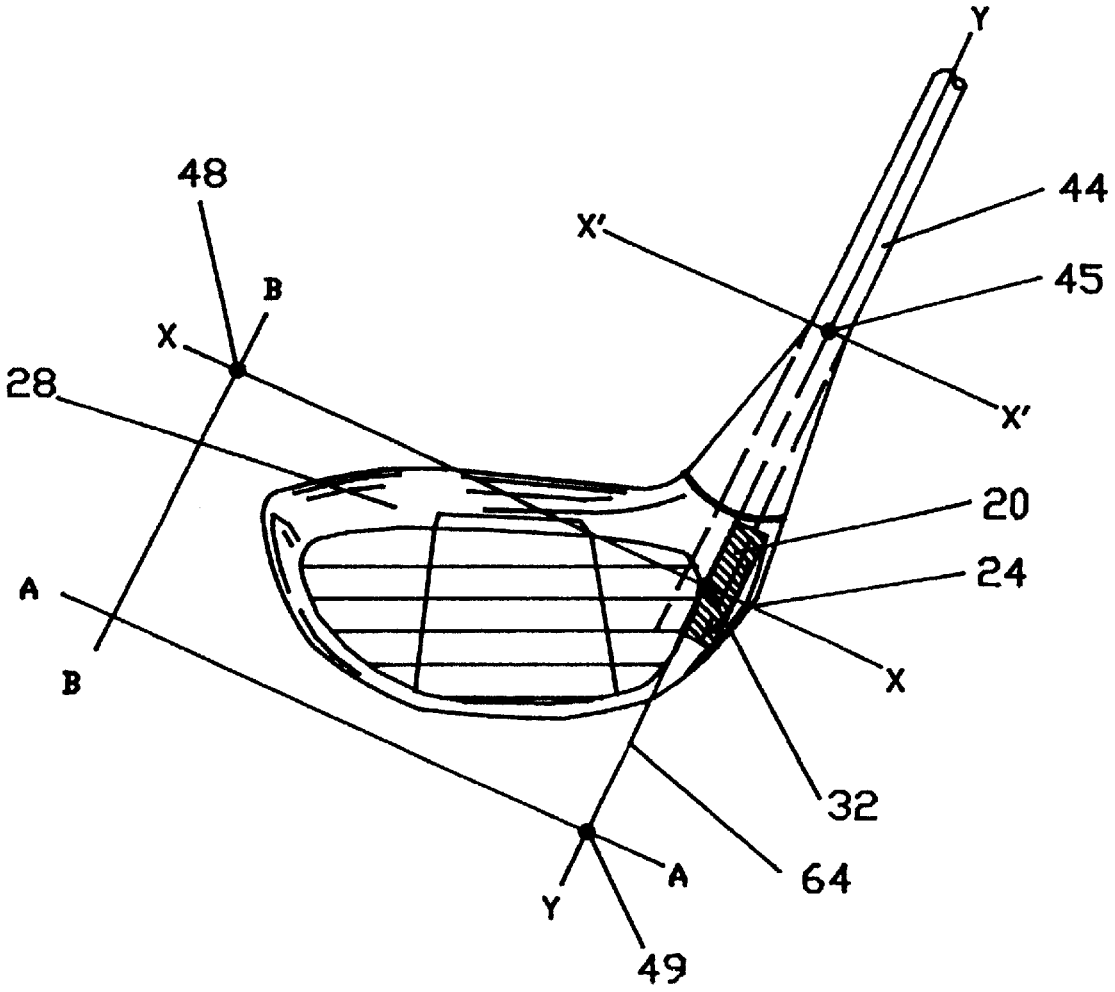
FIG. 1 is a front view showing detail of face

| Reference Numerals | |
|---|---|
| 2 | Pivot Axis |
| 3 | Translation Motion through the CG |
| 4 | Rotational Motion about an Pivot Axis |
| 5 | Moment Around the COP Location |
| 6 | Moment Around the CG Location |
| 7 | Reaction Force at COP Location |
| 8 | Reaction Force at CG Location |
| 9 | Clubhead, Metal Wood Style |
| 10 | Clubhead, Persimmon Wood Style |
| 11 | Outer Limit of Sweet Spot Area |
| 12 | Inner Limit of Sweet Spot Area |
| 13 | Whole Golfclub Axis X-X on Shaft Above Clubhead |
| 14 | Laboratory Constructed Test Boxes |
| 15 | Test Box Internal Weight |
| 20 | Heel Weight |
| 24 | Heel End of Clubhead |
| 28 | Clubhead Body, Typical or Open Mouthed |
| 32 | Center-of-Gravity (CG) |
| 32a | Alternate CG Location |
| 32b | Another CG Location |
| 44 | Club Shaft |
| 45 | Location of Axis X-X on Shaft Above Clubhead |
| 48 | Center of Percussion (COP) |
| 49 | Center of Percussion from X-X Axis on Shaft Above Clubhead |
| 52 | Shaft Centerline Axis |
| 56 | Toe End of the Club |
| 60 | Golf Ball |
| 64 | Shaft's Longitudinal Axis, or Centerline |
| 96 | Butt Weight at Butt End of Shaft |
| 100 | Butt End of Shaft |
| 104 | Center-of-Percussion of Whole Club Along Golf Shaft Which is Located Inside Clubhead |
| 108 | Intersection of Golfer's Hands and Shaft |
| 110 | Entire Golf Club |
| 114 | Pivot Axis for Whole Golf Club |
| 160 | Face Insert Piece |
| 164 | Face Mounting Interface Area |
| 168 | Metal Clubhead Shell with Open Mouth if Insert 160 |
| 170 | Heel Offset |
| 172 | Flanges to Mount Wood Face |
| 174 | LHEAD Dimension |
| 176 | LCG Dimension |
| 178 | LCOP Dimension |
| 180 | Total Weight (WT) |
| 182 | Sweet Spot on Clubhead Face |
| 184 | CG of Shell |
| 186 | CG of Face |
| 188 | LCGS Dimension |
| 190 | LCGF Dimension |
| 192 | Shaft |
| 194 | Pendulum Period of Oscillation (T) |
| 196 | Pivoting Shaft |
| 198 | Frictionless Pivots |
| 202 | 'N' Optimum Value of LCGT |
| 300 | Existing Golf Club in Today's Market |
| 304 | Center-of-Percussion Along Golf Shaft Which is Located Above Clubhead |
| 308 | Sharp Oscillations in Shaft at Ball Contact |
| 312 | Same as 108 Where Golfer Experiences Oscillation 308 |
| 316 | Clubhead of Typical Club Available in Today's Market |

SUMMARY

Clubhead Heel Weight, Golf Club Butt Weight, and Clubhead Wood Face Insert

It is an objective of the present invention to provide a golf club and clubhead design approach that results in an improved golf club. This club technology enables a golfer of any skill level to increase his/her's degree of ball control when striking the golf ball. This patent advances the technology of golf club design and construction over the current state-of-the-art.

Preferred Embodiment—Description

Clubhead Heel Weight

Figure 21:
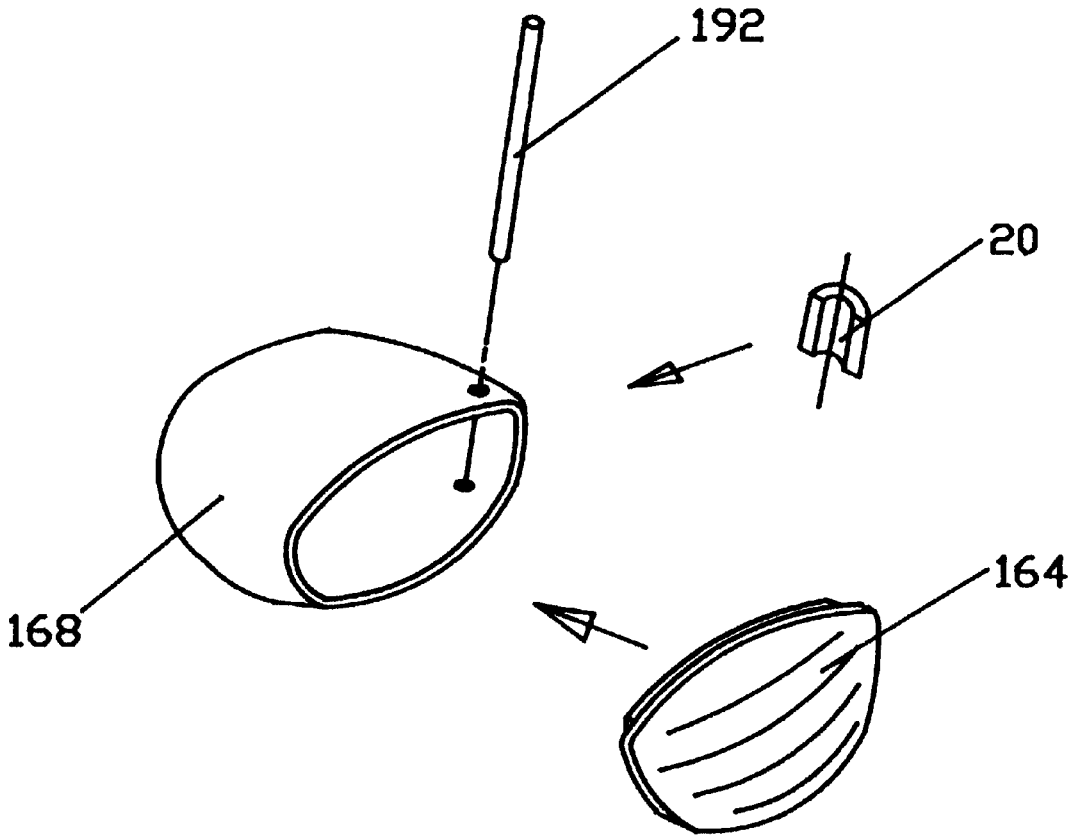
FIG. 21 is a View Showing a Typical 3 Piece Assembly of a Golf Club That Meets the Technical Intent of This Patent
Figure 22:
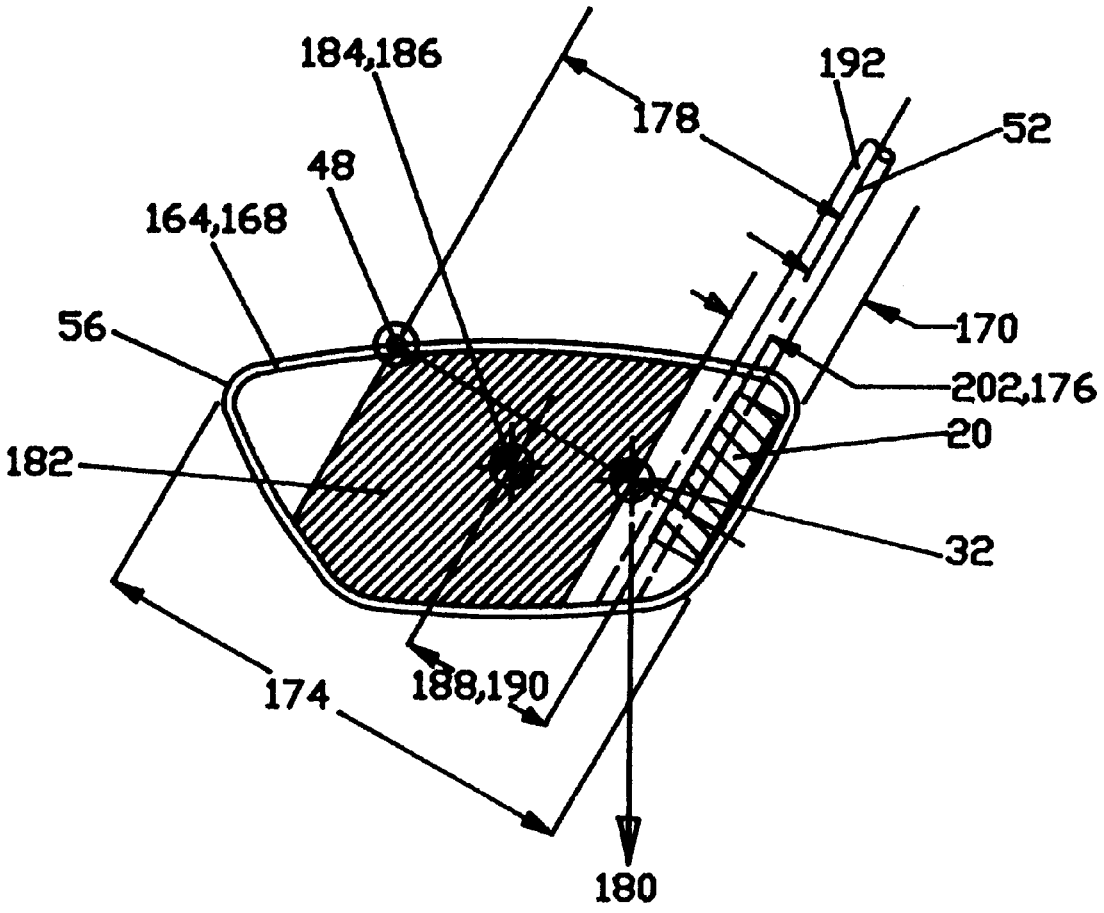
FIG. 22 is a Front View That Defines the Key Parameters in Designing a Golfhead That Meets the Technical Goals of This Patent

The most logical Clubhead design that will produce a golf club that meets the intent of this patent specification is one consisting of three (3) parts attached to shaft 192. They are shown in FIG. 21 and are the Shell 168 (for a metal wood body), the Face 164 (that is fastened to the Shell), and the Heel Weight 20. The proper sizing of the Heel Weight is what locates the Center-of-Gravity 32 where desired; given that the size, shape and weight targets for the Shell and Face are already determined from marketing requirements. The preferred location of the Center-of-Percussion 48 is upon the outer edge of the shell is shown in FIG. 22. The length LCOP 178 is Optimum if equal, or greater than, the length of the golfhead 174. This is for the largest possible Sweet Spot 182. The CGs of the Shell 184 and the Face Piece 186 are fixed lengths 188 and 190 by Marketing Specifications for size and Weight 180. The weight distributions of the Shell 168, the Face 164 and the Heel Weight 20 determine the CG location 176 from Shaft 192 Centerline 52. The distance 170 inside the shaft centerline 52 to the inside physical limit of the clubhead must meet United States Golf Association rules for all clubs except putters. Placing the COP 48 upon the Toe 56 is the minimum accepted condition while locating the COP off the Toe is very acceptable design approach. Locating the COP somewhere between the Toe and where today's clubs have their COP will be an important improvement. There may be other ways to produce a golf club that meets the goals set here. They are not discussed at this time.

DESIGN PROCESS

Initially the following dimensions and parameters are known from the start of the design. They are (referring to FIG. 22):

1) Heel Offset 170 that will meet USGA Rules.
2) LHEAD Dimension 174 will be known after clubhead size is specified.
3) LCG Dimension 176 and LCOP Dimension 178 will be specified after clubhead size is known.
4) Total Weight (WT) 180 of the clubhead should also be specified by Marketing.

The Design Process to be followed to generate a golf clubhead design that meets the Sweet Spot Area 182 goals listed herein is as follows:

1) Determine a preliminary Weight Budget for the main parts.

$$WT=WS+WF+WB$$

where WT is total weight of clubhead
WS is weight of body shell
WF is weight of face
WB is weight of Heel Weight 2) Estimate the rotational inertia (around the shaft centerline) of the Shell 168 and Face 164. Use the SHAPE Functions developed later in this section
3) From Superposition the total inertia JT is calculated.

$$JT=JS+JF+JB$$

where JT is the total rotational inertia around shaft centerline
JS is same inertia for Shell portion of the clubhead
JF is th e same inertia for Face portion of the club-head
JB is the inertia of the Heel Weight 20 which can be calculated after it's weight, shape, and position within the clubhead is determined.

4) The various dimensions to the Centers of interest of the three components are determined from prior requirements for size and shape of the clubhead itself.

LCGS Dimension 176 is from Shaft centerline 52 to CG of Shell 168 part.

(Note that for a metal wood design LCGS=LCGF, and the Shell and Face can be combined.)

LCGF Dimension 190 is from shaft centerline to CG of Face 164 component

LCGB is dimension from shaft centerline to CG of Heel Weight

LCGT 202 is dimension from shaft centerline to CG of whole Clubhead and it can be determined by the following relationship:

$$LCGT*WT=-LCGS*WS-LCGF*WF+LCGB*WB \quad \text{Equation D}$$

5) All the information is now present to determine the dimension from Shaft Centerline Axis 52 to CG of entire clubhead assembly $$LCGT=(-LCGS*WS-LCGF*WF+LCGB*WB)/WT$$

(Distance from the Shaft Centerline to the CG of the Clubhead is Negative Value for the Right Handed Golf Club)

6) Then, the LCOP for the entire clubhead assembly can be estimated from Equation B for the proposed design which in newly defined terms is:

$$LCOP=JT*G/(WT*LCGT) \quad \text{(Inches)}$$

If the estimated clubhead LCOP 178 is not precisely where desired (ie located upon the Toe of the clubhead at LHEAD from the shaft centerline, or further out), then the design is started again with a slightly different Weight Budget. Changing the weights of the three main components of the golfhead is how to move the LCGT (distance to the Center-of-Gravity). The design is thus iterated until the desired Sweet Spot is obtained by this estimation. Then prototype clubheads are built to the specifications derived here. The actual LCOP can be measured using Equation C (described in previous section). The actual produced value for the total inertia J can be measured and verified with Equation A. If the hardware is not close enough to the desired parameters set out for the design, then start over with this process. Having hardware present should allow more accurate estimates of what to change to produce the desired location of LCG and LCOP. The Optimum LCGT 202 is shown in FIG. 22 where the COP 48 is positioned upon the shell wall near the Toe End 56. This provides the maximum size Sweet Spot possible for the club face size and shape used in FIG. 22. This is why the shape and size of the clubhead itself must be determined before the technical design described herein can be executed.

The estimation of rotational inertia's listed above can be easily done by the use of SHAPE functions. The rotational inertia of any mass of very small size, measured from a pivot axis is calculated as J=M*(R**2) where R is the distance to the mass from the pivot axis. However, in the real world, a straight Forward calculation for inertia is not possible. This is due to the fact that 3 differently shaped objects that weigh identically the same, can have different rotational inertia's from a common pivot axis. This is due to the fact the inertia is the summation of many small pieces of mass of the object in question multiplied by the distance to the pivot axis—Squared. The different objects will have different distributions of the small mass pieces, all at different spacings from the pivot axis than the other objects in the study, resulting in 3 different values of J for 3 objects that weigh the same.

Figure 23:
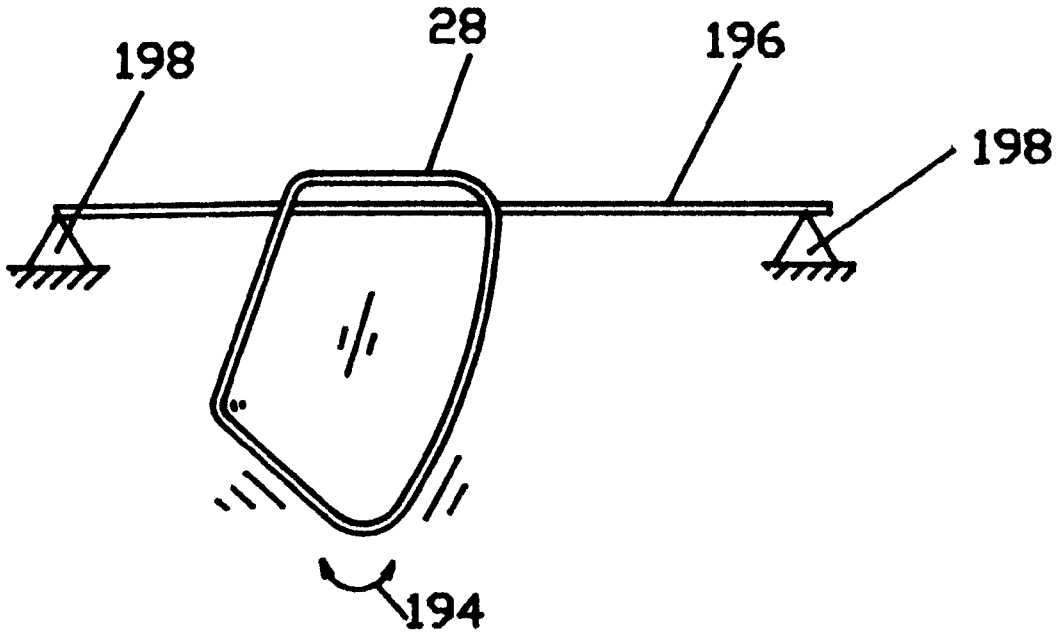
FIG. 23 is a Simplified View of the Laboratory Setup Used to Measure the Period of Pendulum Oscillation of a clubhead (T)

Determining the rotational inertia about any axis for an object that already exists is straight forward. It is done using the Pendulum Period of Oscillation (T) 194 (Referring to FIG. 23) and the Equation A. However, for a new design, this is not possible. The final dimensions cannot be made without knowing what the rotational inertia would be for the design—after being assembled. In the case of a metal shell used for a metal wood golf club, the rotational inertia about the shaft axis can be done as follows:

$$JS(expected)=KS*WS*(LCGS**2) \text{ Where,}$$

JS is the expected Rotational Inertia about it's pivot axis

KS is the SHAPE Function mentioned previously

WS is the budgeted weight for the Shell piece, and

LCGS is the projected distance to it's CG from the shaft centerline

LCGS can be easily estimated to be the geometric center of the clubhead final shape measured from the projected pivot axis. It is a symmetrical part and adding weight all around and clanging height or weight will result in the CG still being at the geometric center of the part. This is viewed from the front of the face. Taking many Shells available to one in the golf club business, made of various materials such as steel, titanium, magnesium, aluminum, zinc and plastic, and then measuring their Pendulum Period (T) on a test stand shown in FIG. 23 their J values can be calculated. This Figure shows the clubhead suspended upon a Pivoting Shaft 196 that rests upon two Frictionless Pivots 198 on either side. The various part samples are then setup and their respective Periods of Oscillation (T) 194 measured. Then using Equation A, their respective real rotational inertia's are determined. Plugging these results into the SHAPE Equation above; the value of KS and it's variation can be calculated. In this case, the values of KS for the Shell piece and the Face piece were individually consistent with very little variation. The projected rotation inertia for the projected clubhead design parts could be made with a lot of confidence. The SHAPE functions for the two parts are as follows:

$$KS(Shell)=9.2\ E\text{-}06(lb\text{-}sec**2/gram)$$

$$KS(Face)=6.1\ E\text{-}06$$

Consequently when the clubhead size and total weight goals are set preliminary values for JF and JS can be calculated and used in this iterative design process. JB can be estimated as WB*(LCGB**2)/G where distance to it's CG (LCGB) is easily determined from the part design shape.

The final objective is to produce a clubhead assembly that has it's Center-of-Percussion located exactly upon the Toe End of the Club 56 (or further out off the Toe—if preferred). This is possible if the Center-of-Gravity 32 is located where LCOP equals 'N' Optimum Value (or on the shaft centerline—if preferred).

Golf Club Butt Weight

Figure 4:
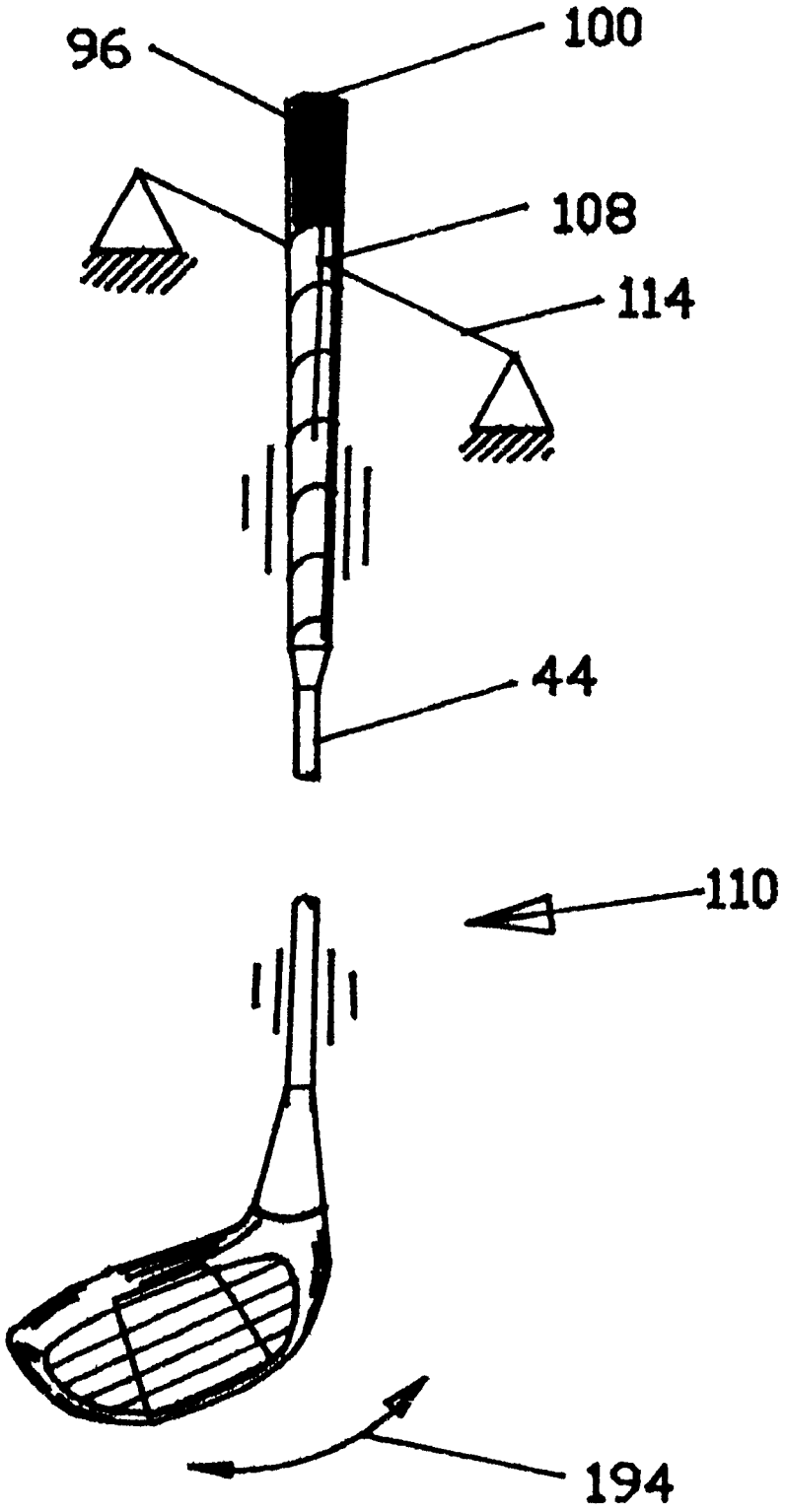
FIG. 4 shows the pivot location for measuring Center-of-Percussion of a whole golf club FIGS. 5A and 5B compare the wood insert invention compared to standard Persimmon wood clubhead

As was mentioned previously the movement to lighter golf shafts in all golf clubs is moving the Center-of-Percussion (COP) of the whole golf club closer to the clubhead, but not inside The prior art teaches adding a shaft Butt Weight above the assumed pivot axis of the grip end of the golf club. This moves the COP downward into the clubhead itself. The Miggin's Patent teaches the correct method to measure precisely where the COP resides in an assembled golf club. FIG. 4 shows the pivot configuration used to measure the Pendulum Oscillation Period (T) per the Miggins's Patent setup.

With any specific golf shaft on known weight, and specific overall length of club to be built, there is a specific Butt Weight value that will place the COP directly upon the CG of the clubhead. The method described in the Clubhead Heel Weight section of this patent can be followed in placing the clubhead CG. The preferred location of the club's COP is right or top of the clubhead CG, or within 0.05 inches in any direction. When the CG of the clubhead is located on the centerline of the shaft then putting the club's COP right on top, or within 0.05 inches, is the best combination for an outstandingly performing golf club.

Second choice for the Preferred Embodiment is to place the COP of the whole club within 0.50 inches of the clubhead CG.

Clubhead Wood Face Insert

Figure 5A:
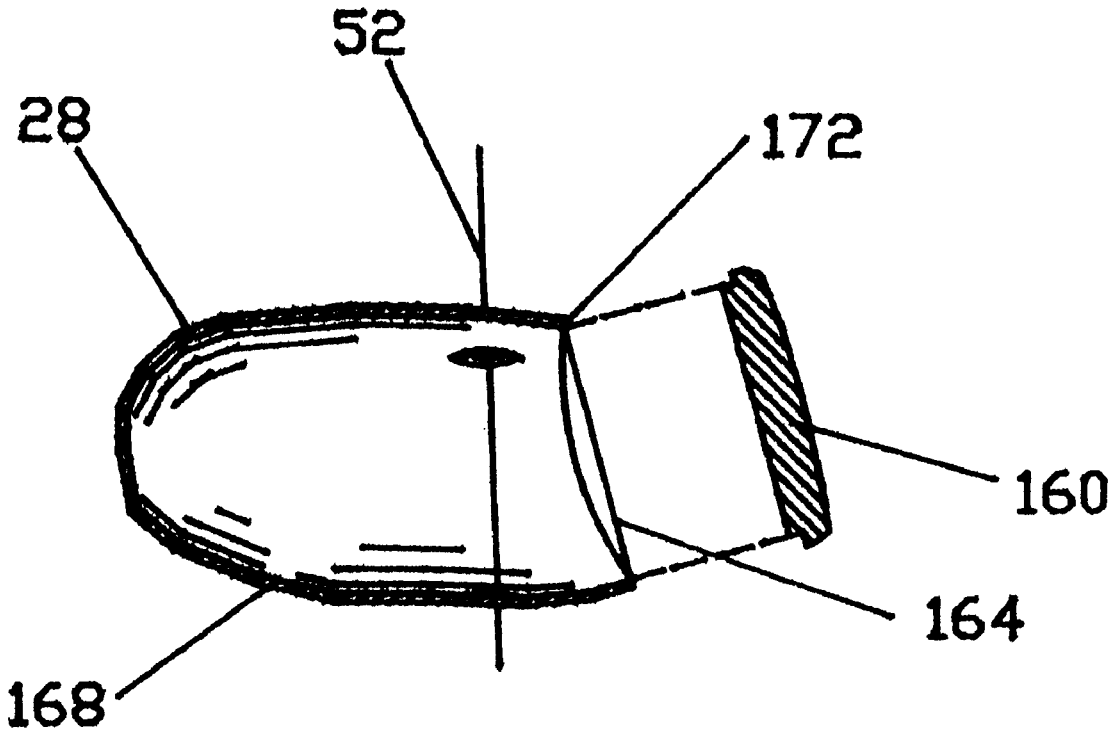
Figure 5B:
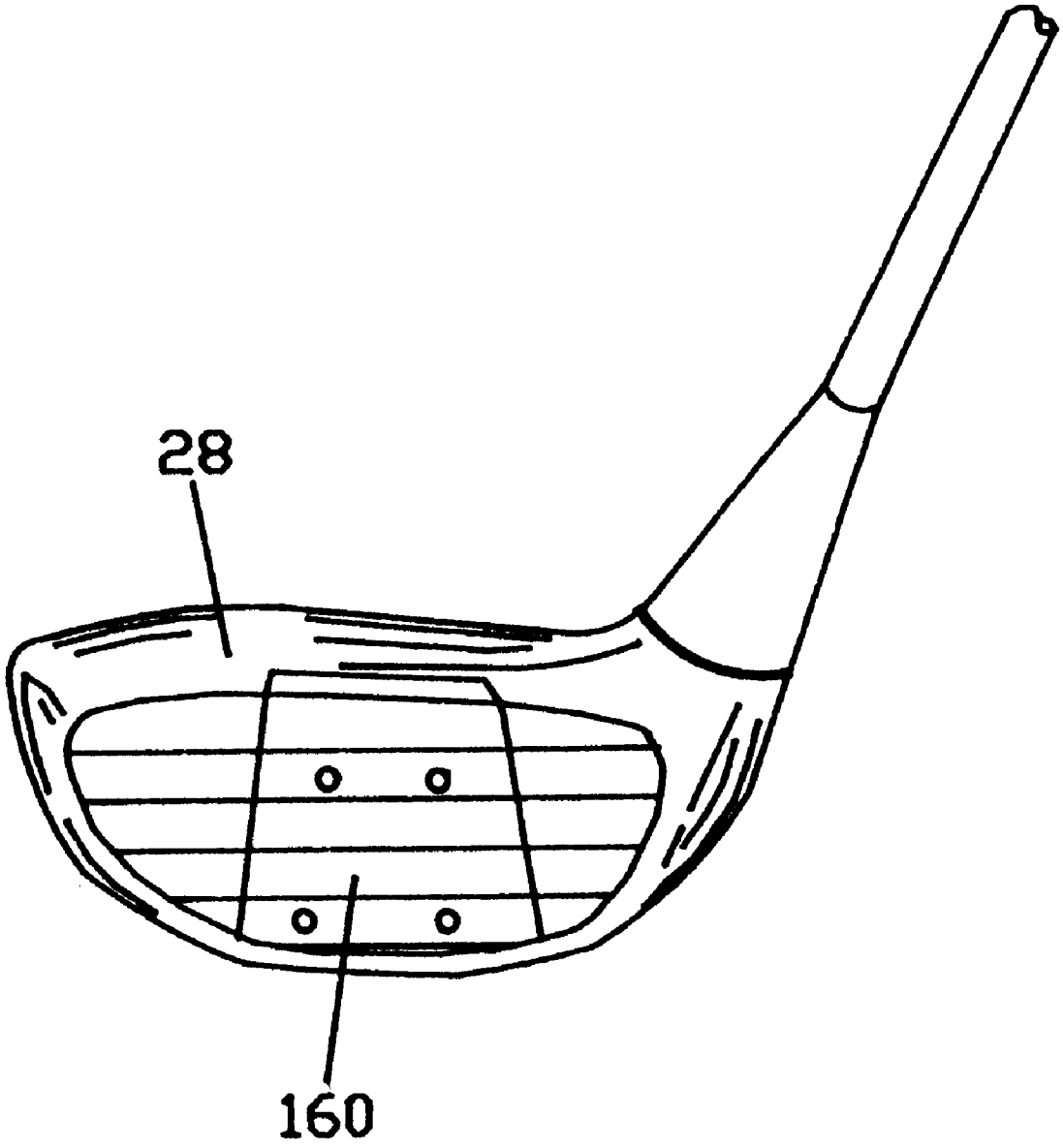
Figure 11:
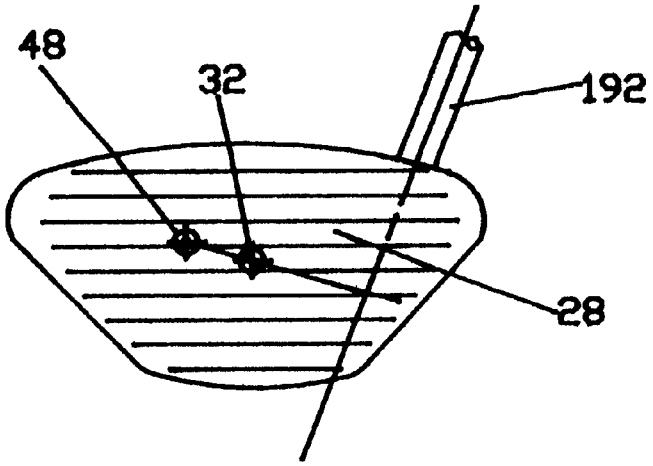
FIG. 11 is a Simplified Front View of a Wood Style Golf Head and Shaft Tip Section Showing It's Center-of-Gravity (CG) Location Relative to It's Center-of-Percussion (COP) Location
Figure 12:
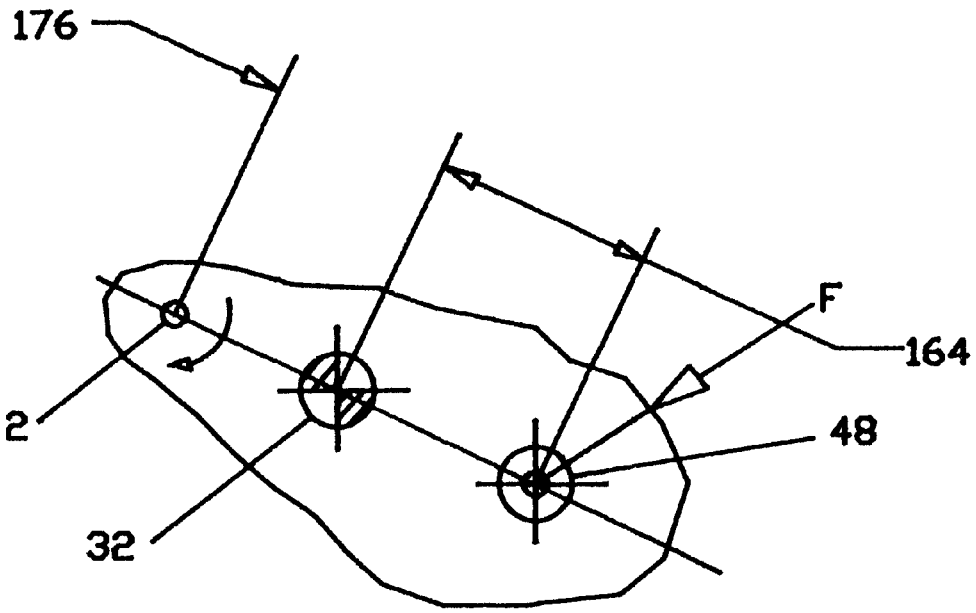
FIG. 12 is a Free Body Diagram Normally Used in the Engineering Technical Literature to Describe the COP Relative to the CG Rotating About a Pivot Axis
Figure 13:
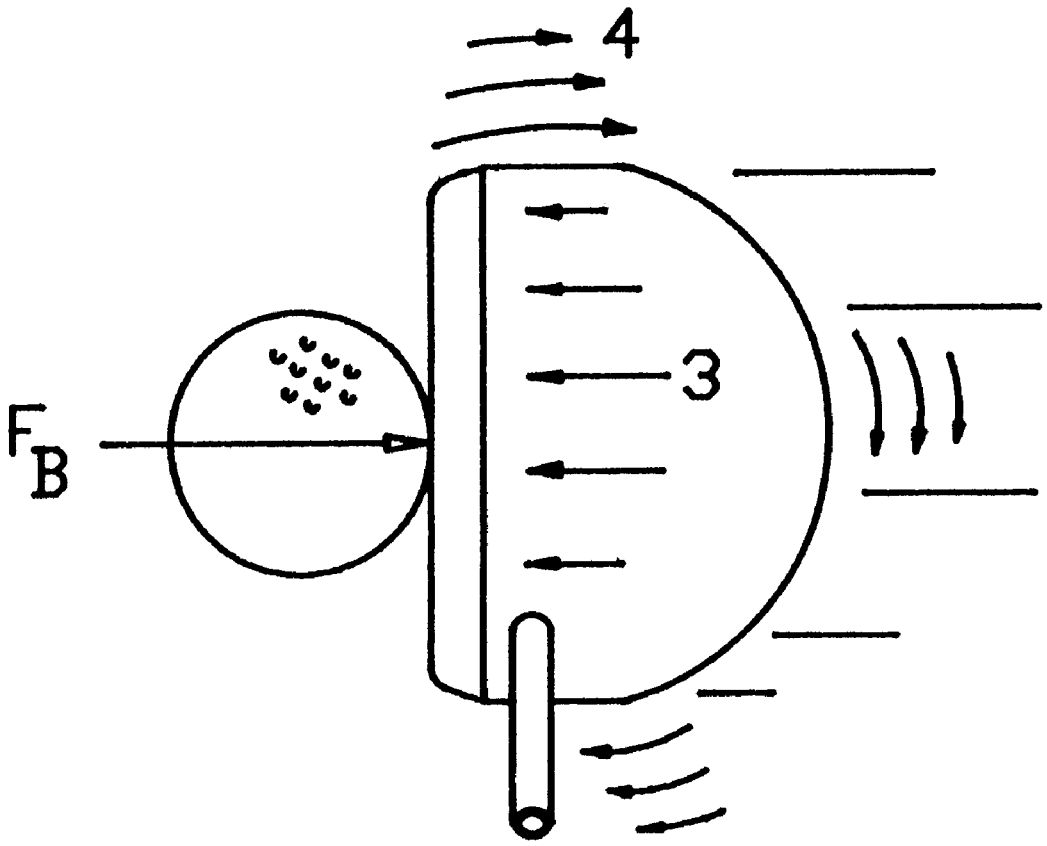
FIG. 13 shows a Top View of a Typical Golfhead and it's Two Normal Conditions of Movement When the Golf Ball is Contacted-Rotation About the Shaft and Translation Along the Swingline FIGS. 14A&B shows the Development of Reactive Forces and Moments at Both the COP and CG Centers From Impact Force Inside and Outside These Respective Centers FIGS. 15A&B show the Relative Sizes of the COP-to-CG Defined Sweet Spot for a Wood-Wood and a Metal Wood Golf Club
Figure 14A:
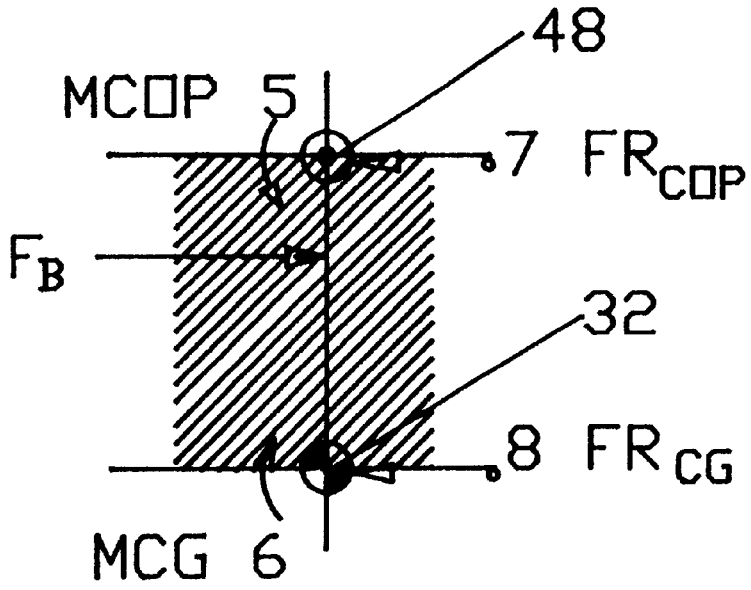
Figure 14B:
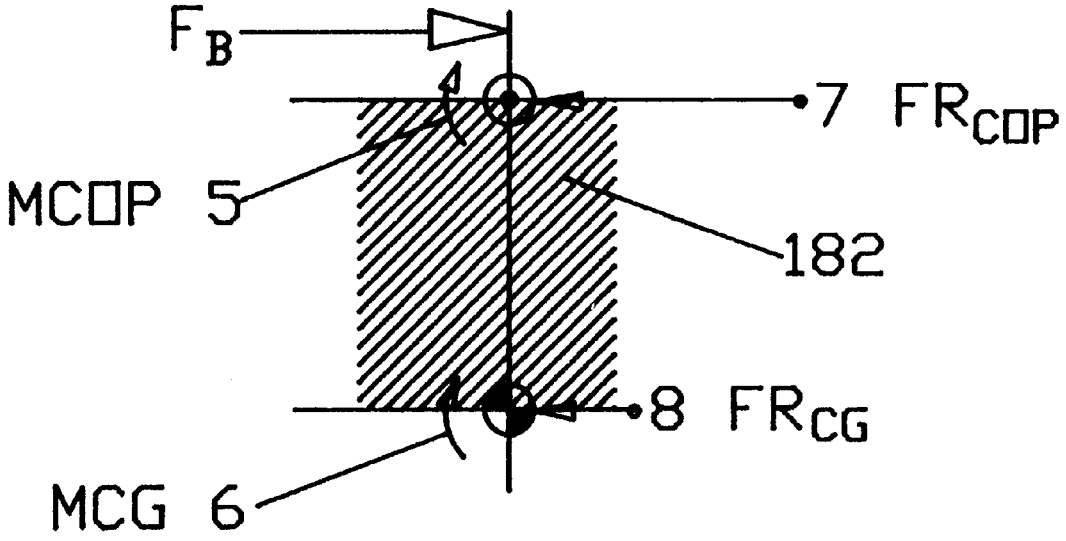
Figure 15A:
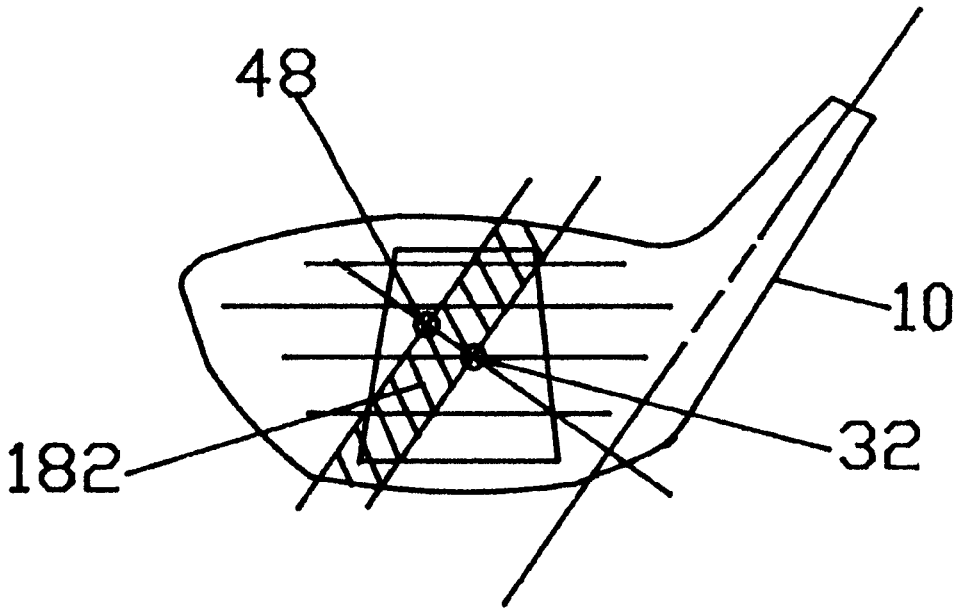
Figure 15B:
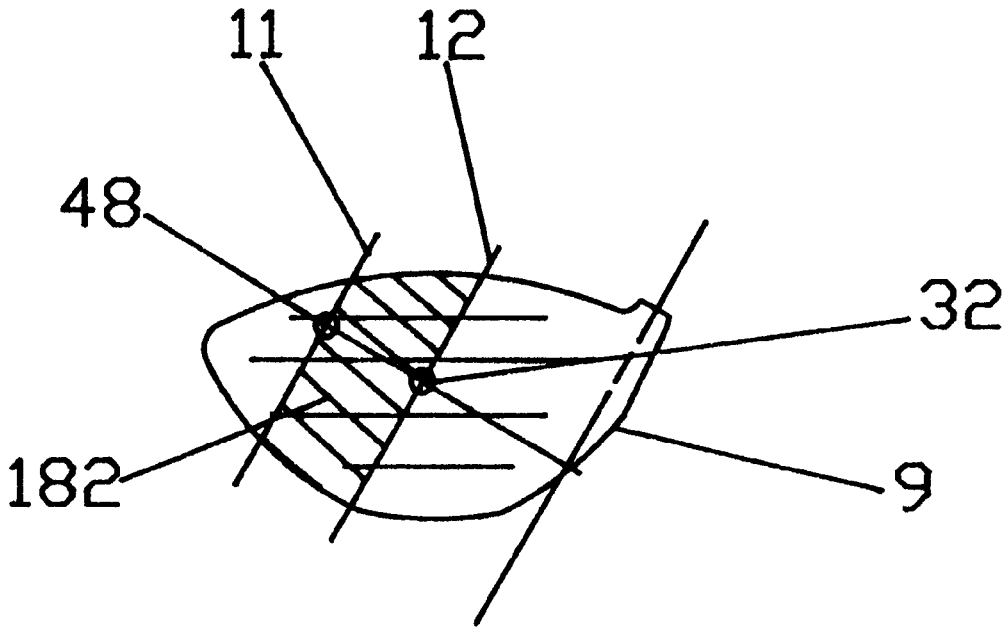
Figure 16:
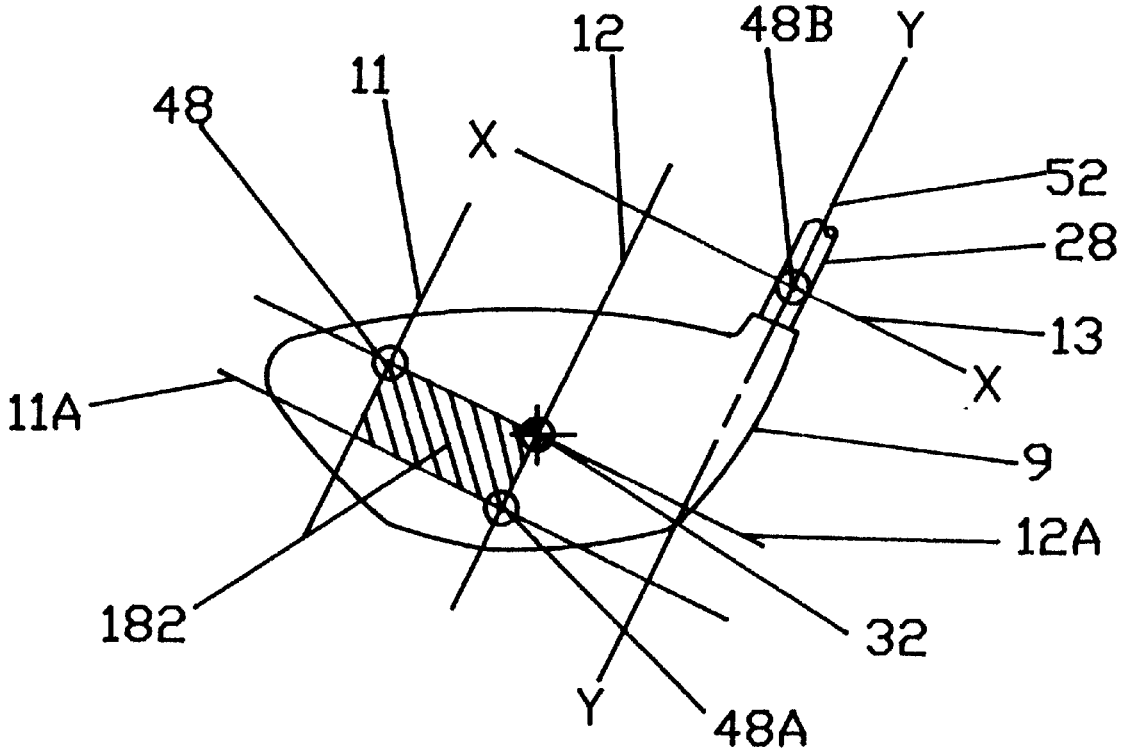
FIG. 16 shows the Projected Front Face View of the Resulting COP-to-CG Sweet Spot if Rotation at a Point Above the Clubhead is Significant
Figures 17A, 17B, 17C, 17D, 17E, 17F:
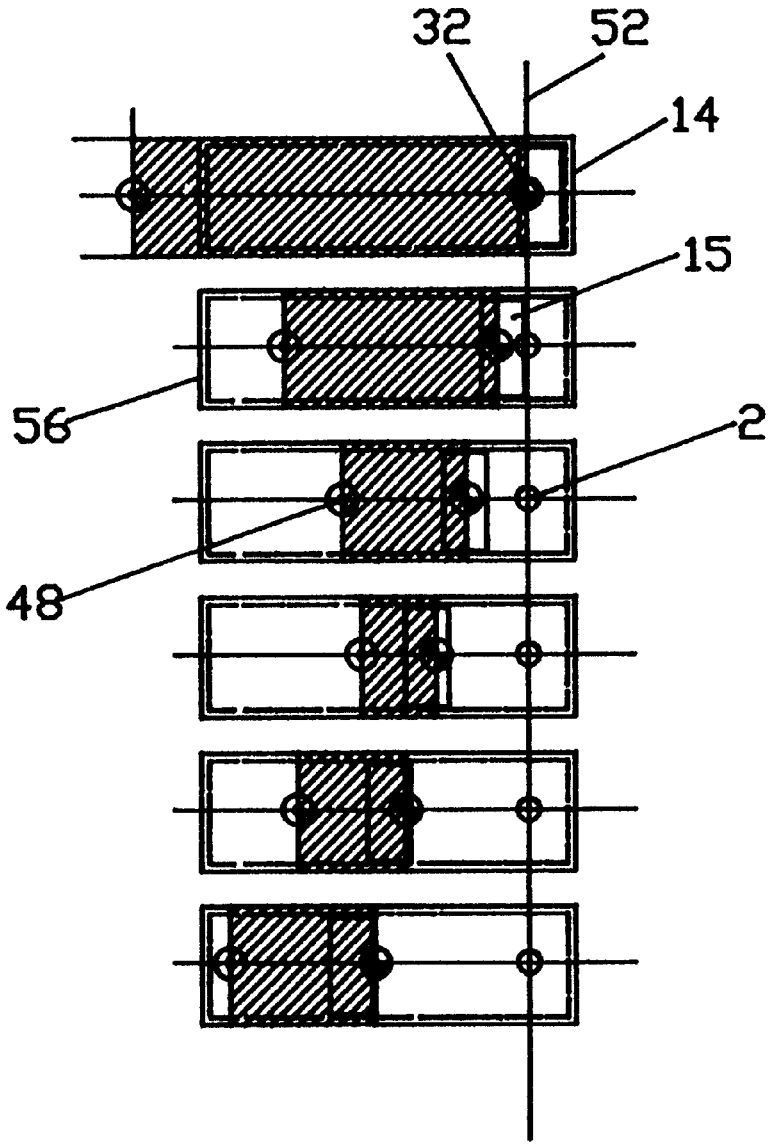
FIGS. 17A–F show a Laboratory Experiment Result Where the Various Figures Depict a Set of Identical Size and Weight Clubheads (as boxes) with Various Locations of CGs Measured from Identical Pivot Axis'
Figure 18A:
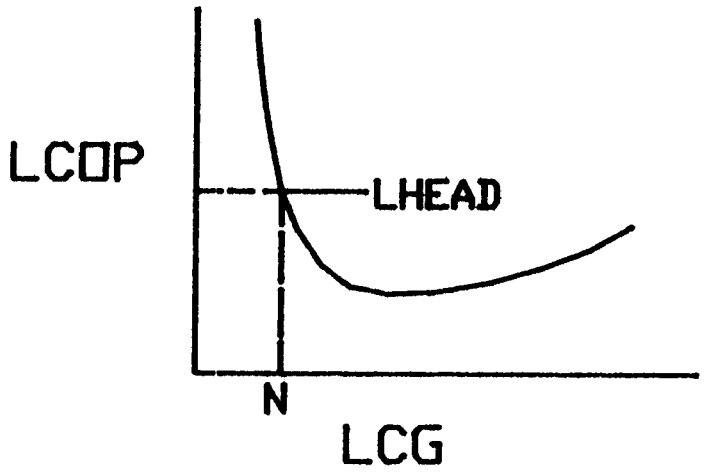
FIGS. 18A&B show the Relationships of LCOP and Sweet Spot Versus LCG Based Upon Data From FIG. 17 Data
Figure 18B:
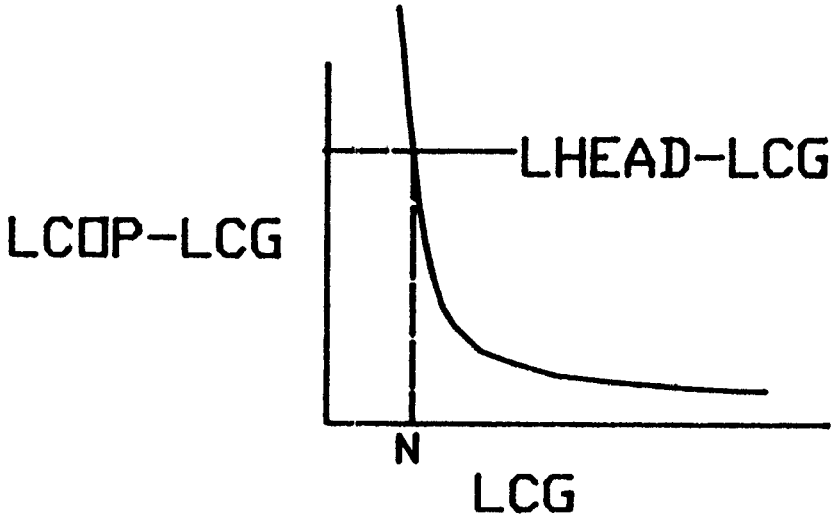
Figure 19A:
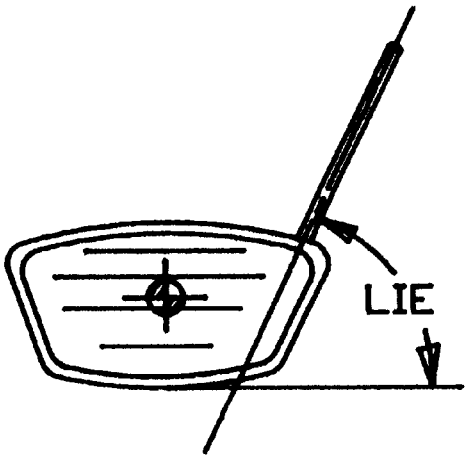
FIGS. 19A–C show the Location of the CG of a Typical Wood-Wood, or Metal Wood Golf Clubhead
Figure 19C:
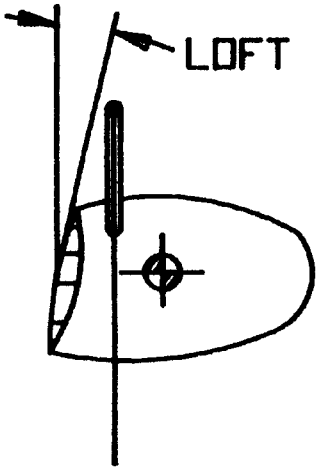
Figure 19B:
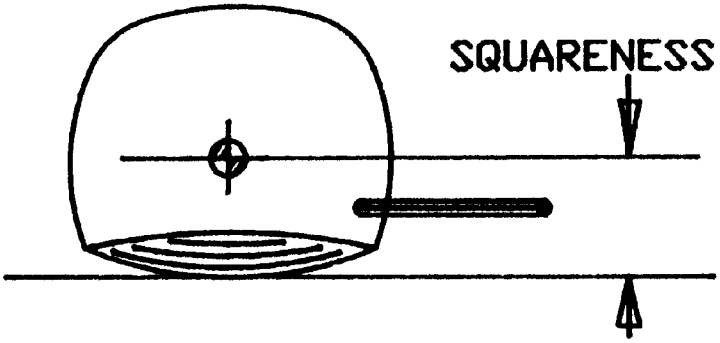
Figure 20A:
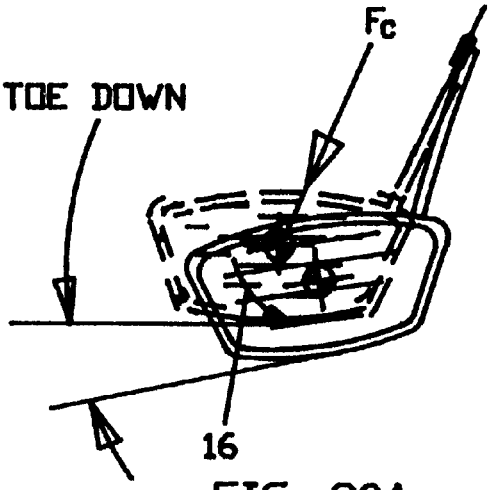
FIGS. 20A–C show the Resulting 'Toe-Down', 'Rotation' and 'Loft Increase' Caused by Centrifugal Forces During Downswing on the Club Shown in FIG. 19
Figure 20C:
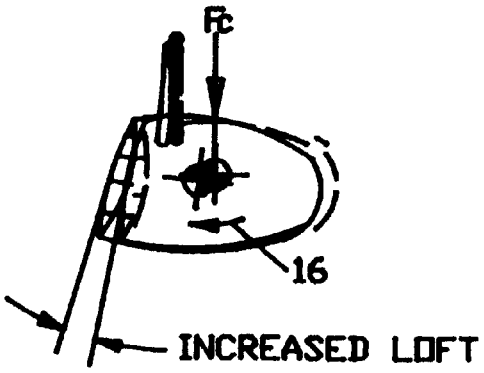
Figure 20B:
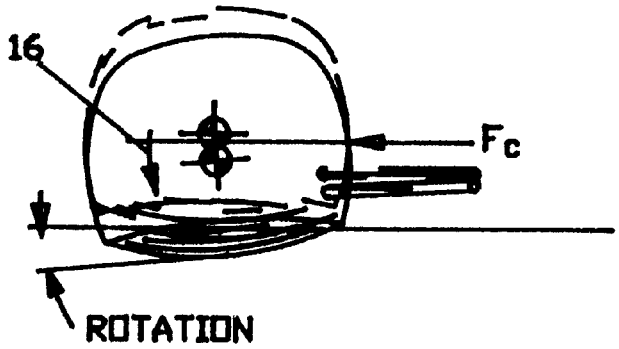

The preferred embodiment is to start with an Open Mouth Metal Shell Clubhead Body and attach a Face Piece made of Persirmon or Maple Wood, or Laminated Phenolic. FIG. 5A shows a separate Face piece 160 being attached to an Open Mouthed Clubhead 28. The Face piece 160 is attached by some very adequate 2 part (or 3 part) adhesive means to Flange 172 in the Clubhead Body 28. A Polymer backing material such as Bisphenol A/epichlorohydrin Resin, with Allphatic and Aromatic Glycidyl Ethers combined by mixing with Nonyl Phenol Polyoxyalkaleneamines, and N-Aminoethylpiperazine (commercially available as ETI, Fields Landing, Calif., Ultra-Glo(™) or EnviroTex Lite Pour-On(™). This material is mixed and poured inside the clubhead when it is assembled and allowed to cure directly behind the Face piece at Face Area 164. Since this is the final major piece of the Clubhead Assembly the total weight of the head can be controlled by the amount of the specified Polymer added as described above. The Polymer specified above is the preferred embodiment of this patent, however some other Polymer may be found to work also.

Preferred Embodiment—Operation

Clubhead Heel Weight

In order to provide the specifications of a clubhead that will meet the objectives of this patent, the distribution, location, and size of the Heel Weight compared to the size, weicht, and shape of the clubhead Shell and Face pieces must be controlled. They must be designed correctly to obtain the distance to the Center-of-Gravity that provides these features, measured prom the shaft centerline when the head is built. After the engineering prototype clubhead is physically built from the selected materials, then the Center-of-Percussion can be measured exactly by determining it's Pendulum Oscillation Period (T), it's real Center-of-Gravity location (LCGT), it's resultant total Weight (WT), and using Equation A. If the results are not exactly as desired, then the process can be repeated.

Golf Club Butt Weight

Figure 2A:
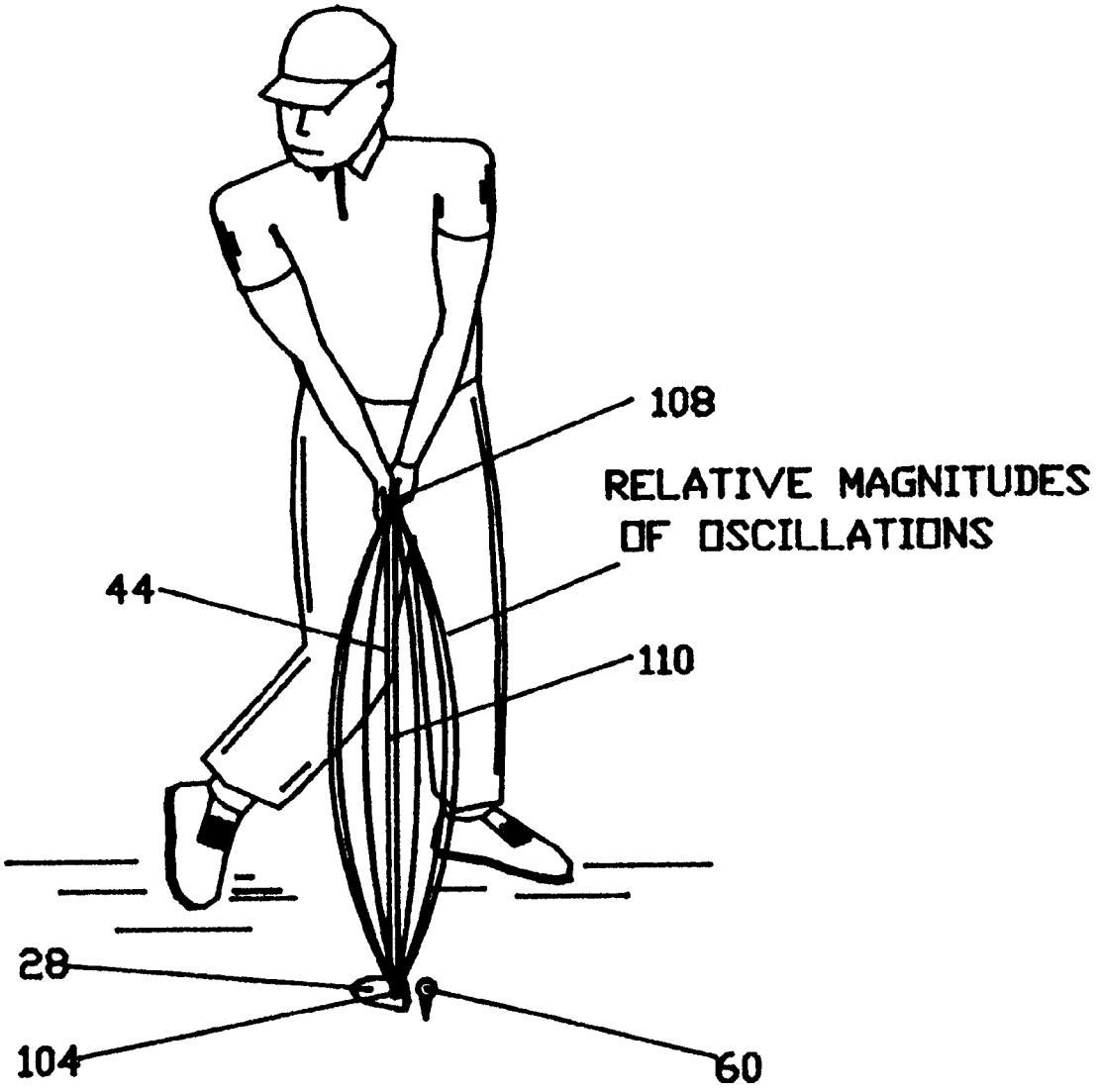
FIGS. 2A, 2B and 2C show when golf ball is struck by golfer
Figure 2B:
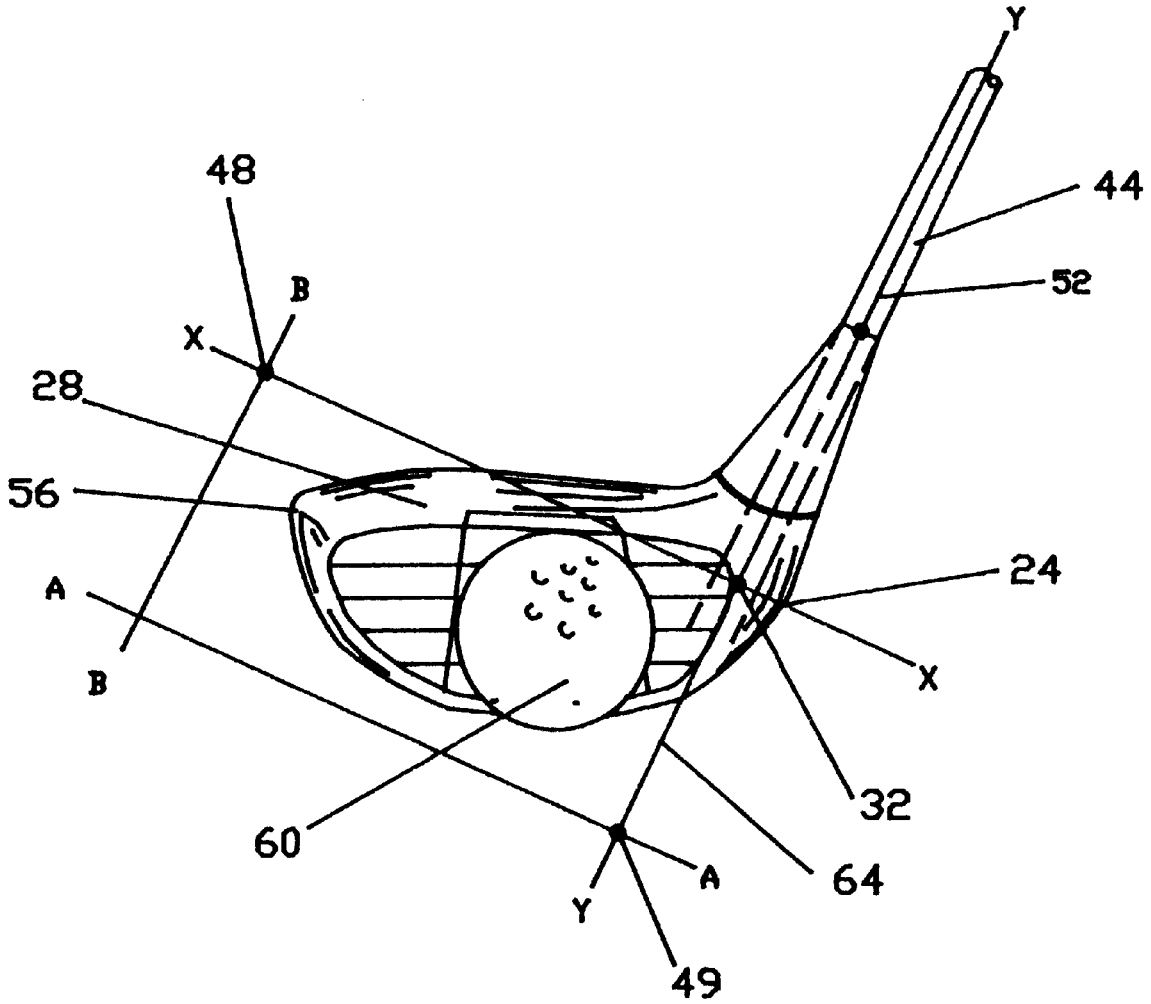
Figure 2C:
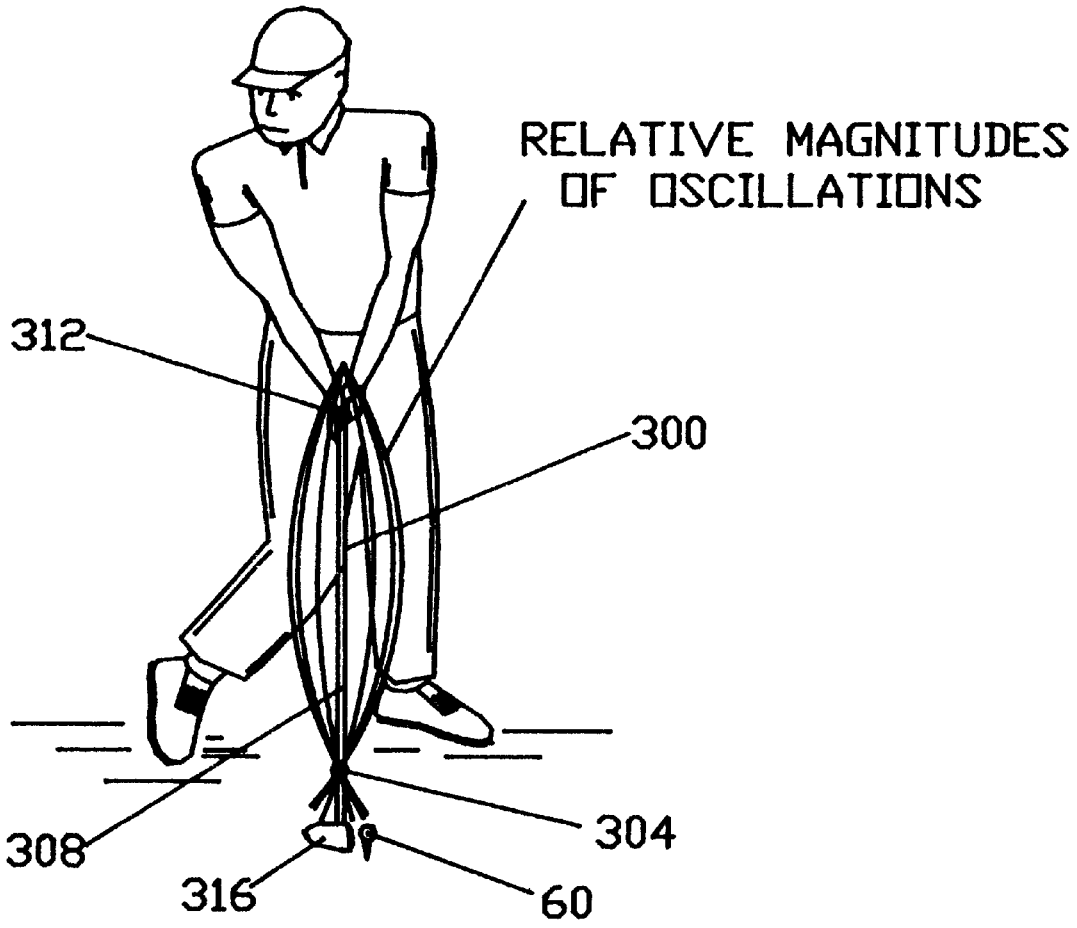

A Butt Weight 96 shown in FIG. 4 located at the grip end of the golf club 110 will move the whole club's Center-of-Percussion (COP) 304 from the location shown in FIG. 2C to the Center-of-Gravity of the clubhead itself 32 shown in FIG. 22. The COP on a golf club with NO Butt Weight is shown in FIG. 1C at location 45 which is the location of a pivot axis X'—X' shown normal to the shaft centerline. By adding a Butt Weight 96 as described of precise weight one can move the COP of the whole club down to the CG of the clubhead 32. Today's graphite golf shaft being of lighter weight means that lighter Butt Weights can be used to precisely locate the club's COP. Heavier golf shafts means heavier Butt Weights.

By locating the whole club's COP 304 within 0.00 to 0.05 inches within the clubhead CG 32 location will provide the best touch and feel response in the golfer's hands during ball contact. The choice of 0.00 to 0.05 inches was made based upon production of building clubs to this patent where effort to precisely located the COP 304 to the CG 32 in compared to cost effective process times. The 0.05 to 0.50 inch location control will work well, but not as good as the preferred location control of 0.00 to 0.05 inches.

FIGS. 2A and 2C show the two limits of vibration range that the golfer will feel on different clubs. The preferred location of within 0.05 inches will be very close to that shown in FIG. 2A, while the location control from 0.05 to 0.50 inches will fall somewhere between the vibration pictures shown by FIGS. 2A and 2C.

FIG. 2A shows no translation motion at ball contact because the First Node of Vibration is at the head. This is why there is more energy transferred at ball contact than what is shown in FIG. 2C.

Clubhead Wood Face Insert

The Open Mouth Shell 28 can be of one-piece construction such as a forging or casting of the desired material. Such materials can be steel, titanium, magnesium, aluminum, zinc, or any other useful metal. The Face piece 160 is cut from Solid Persimmon Wood, Laminated Persimmon Wood, Laminated Maple Wood, or Laminated Phenolic Insert materials. If desired face grooves can be included with the specified Bulge and Roll Radii. The specified Loft Angle of the Face of the Club itself is accounted for here. Also a secure mounting flange is provided within the Mouth section of the Clubhead Body 28. The Face pieces are backed up with an integral addition of compatible Polymer Backing Material A large amount of testing both on the bench and on the golf courses and practice ranges have shown these combinations to work very well. It gains it's additional strength from the known phenomena where two structural parts merged into an integrated assembly can be stronger than the sum of the individual parts. This is the case with this patent, and it provides a superior golf club design.

Conclusions, Ramifications, and Scope

Clubhead Heel Weight

Accordingly, it can be seen that incorporating the technical content of this patent will provide a golf clubhead with the maximum possible protection against off-center golf ball hits with the club. The use of Center-of-Gravity location finally resolves the difficulties golfers of all skills have had in understanding what is meant by 'Sweet Spot' in golfclub advertisements. The benefits from proper placement of the clubhead's Center-of-Gravity relative to it's Center-of-Percussion will result in better golf playing and snoring. Actual hitting of golf balls at practice ranges and on actual golf courses with clubs (particularly Drivers) built to this patent's specifications and intent have shown the principles to be of sound technology and outstanding performance. This patent works.

Golf Club Butt Weight

Golfer's that have experienced 'Tennis Elbow' from playing golf have been able to play well with clubs built with the invention. All golf shots made with clubs built this way will feel more solid. Distances on shots made with these clubs are measurably larger as the energy transfer efficiency is higher. This was verified in laboratory analysis using accelerometers. And last but not least golfer's will not necessarily need to wear hand gloves. This is due to the very large reduction of vibration energy felt by the golfer's hands during ball contact.

Clubhead Wood Face Insert

A Golf Club Driver constructed with a Wood-Metal-Wood Club approach per the patent described herein will outperform and outlast ALL of the Drivers listed in the referenced Golf Magazine Club Test article published in August 1998 by Rob Saurhaft.

Today's Metal Woods with their various metal faces will eventually develop flat spots, reduce the advantages that the Bulge and Roll Face Radii have on shot trajectory, and will continue to 'clank' when the ball is hit. While golfers are use to this 'ear' shattering sound today, a return to the 'sweet' feel of Persimmon/Phenolic classic Wood Face can be easily be accepted, especially when the advantages of the Metal Wood are included in the golf club design.

Although the descriptions previously described contain many specifics, these should not be construed as limiting the scope of the invention. It merely is providing illustrations of some of the presently preferred embodiments of this invention. Various other embodiments and ramifications are possible within it's scope. Thus, the scope of the invention should be determined by the appended claims and their legal equivalents, rather than by the examples given.

What is claimed is:

1. A golf clubhead, comprising:

a clubhead shell, a clubhead face, and a club heel weight;

a clubhead shaft mounting means having a centerline;

said clubhead constructed of said clubhead shell, said clubhead face, and said clubhead heel weight attached near said clubhead shaft mounting means, said clubhead having a center-of-gravity location within 0.180 inch maximum measured in any radial direction and distance measured from said clubhead shaft mounting means centerline, said location of said center-of-gravity depending upon said clubhead's features as size, shape and distributed weight, said clubhead having a center-of-percussion located as a result of said center-of-gravity's location which is within 0.500 inch of an outer toe end portion of said clubhead measured from said toe end physical outer limit towards said clubhead's said center-of-gravity;

wherein a design process used to produce said clubhead is clearly defined and established to determine said location of said center-of-gravity that will produce said center-of-percussion location on said clubhead said toe end; and wherein a resulting sweet spot of said clubhead, which is a ball contact surface area projected onto said clubhead face between said center-of-gravity and said center-of-percussion with reference to said shaft mounting means centerline, will be a largest possible size according to the size, shape, and weight distribution of said clubhead.

2. A golf clubhead, comprising:

a clubhead shell and face combination, a club heel weight and a clubhead shaft mounting means having a centerline;

said clubhead constructed of said clubhead shell and face combination and said heel weight, said heel weight attached near said clubhead shaft mounting means. said clubhead having a center-of-gravity location within 0.180 inch maximum measured in any radial direction and distance measured from said clubhead shaft mounting means centerline, said location of said center-of-gravity depending upon said clubhead's features as size, shape and distributed weight;

said clubhead having a center-of-percussion located as a result of said center-of-gravity's location which is within 0.500 inch of an outer toe end portion of said clubhead measured from said toe end physical outer limit towards said clubhead's said center-of-gravity;

wherein a design process used to produce said clubhead is clearly defined and established to determine said location of said center-of-gravity that will produce said center-of-percussion location on said toe end within 0.500 inch; and wherein a resulting sweet spot of said clubhead, which is a ball contact surface area projected onto said clubhead face between said center-of-gravity and said center-of-percussion with reference to said shaft mounting means centerline, will be a largest possible size according to the size, shape, and weight distribution of said clubhead.

3. A golf clubhead, comprising:

a clubhead shell and heel weight combination, a clubhead face, and a clubhead shaft mounting means;

said clubhead constructed of said shell and heel weight combination and said clubhead face, said heel weight portion of said combination being physically located attached near said clubhead shaft mounting means, said clubhead having a center-of-gravity location within 0.180 inch maximum measured in any radial direction and distance measured from said clubhead shaft mounting means centerline, said location of said center-of-gravity depending upon said clubhead's features as size, shape and distributed weight;

said clubhead having a center-of-percussion located as a result of said center-of-gravity's location which is within 0.500 inch of an outer toe end portion of said clubhead measured from said toe end physical outer limit towards said clubhead's said center-of-gravity;

wherein a design process used to produce said clubhead is clearly defined and established to determine said 0.180 inch maximum location of said center-of-gravity that will produce said center-of-percussion location on said toe end; and wherein a resulting sweet spot of said clubhead, which is a ball contact surface area projected onto said clubhead face between said center-of-gravity and said center-of-percussion with reference to said shaft mounting means centerline, will be a largest possible size according to the size, shape, and weight distribution of said clubhead.

* * * * *